US005582644A

United States Patent [19]

Gaddis et al.

[11] Patent Number: 5,582,644

[45] Date of Patent: Dec. 10, 1996

[54] HOPPER BLENDER SYSTEM AND METHOD FOR COATING FIBERS

[75] Inventors: Paul Gaddis, Renton; Ferhan Kayihan, Tacoma; Jeanne Bernards, Edmonds, all of Wash.; David Hayden, Minneapolis, Minn.; Octave Levenspiel, Corvallis, Oreg.

[73] Assignee: Weyerhaeuser Company, Tacoma, Wash.

[21] Appl. No.: 205,354

[22] Filed: Mar. 2, 1994

Related U.S. Application Data

[63] Continuation of Ser. No. 812,054, Dec. 17, 1991, abandoned.

[51] Int. Cl.[6] ..... B05B 17/00

[52] U.S. Cl. ..... 118/303; 366/314; 366/342

[58] Field of Search ..... 366/317, 325, 366/342, 314; 118/303

[56] References Cited

U.S. PATENT DOCUMENTS

| | | | |
|---|---|---|---|
| 1,812,106 | 6/1931 | McCullough | 366/314 |
| 1,827,710 | 10/1931 | Leyst-Müchenmeister | 162/57 |
| 1,971,800 | 8/1934 | Traphagen | 366/314 |
| 2,577,802 | 12/1951 | Payne | 366/325 |
| 2,601,597 | 9/1952 | Daniel . | |
| 2,746,608 | 5/1956 | Briggs | 427/202 |
| 2,757,150 | 7/1956 | Heritage . | |
| 2,950,752 | 8/1960 | Watson et al. | 154/1 |
| 2,953,187 | 9/1960 | Francis, Jr. | 154/29 |
| 2,954,174 | 9/1960 | Polleys | 366/314 |
| 3,010,161 | 11/1961 | Duvall | 19/156 |
| 3,013,525 | 12/1961 | Fuller et al. . | |
| 3,021,242 | 2/1962 | Touey | 427/202 |
| 3,081,207 | 3/1963 | Fox | 154/44 |
| 3,117,027 | 1/1964 | Lindlof et al. | 118/303 |
| 3,222,141 | 12/1965 | Donaldson | 366/325 |
| 3,361,632 | 5/1967 | Gagliardi et al. | 117/143 A |

(List continued on next page.)

FOREIGN PATENT DOCUMENTS

| | | | |
|---|---|---|---|
| 0392528 | 10/1990 | European Pat. Off. . | |
| 1062959 | 12/1952 | France . | |
| 1048013 | 12/1958 | Germany . | |
| 1902981 | 1/1969 | Germany | 366/314 |
| 1632450 | 12/1970 | Germany . | |
| 2023659 | 11/1971 | Germany . | |
| 20258684 | 3/1988 | Germany . | |
| 1121339 | 10/1984 | U.S.S.R. | 162/57 |
| 722841 | 1/1952 | United Kingdom . | |
| PCT/US90/01580 | 3/1990 | WIPO . | |
| PCT/US90/01508 | 3/1990 | WIPO . | |
| PCT/US90/01505 | 3/1990 | WIPO . | |
| PCT/US90/01506 | 3/1990 | WIPO . | |
| PCT/US90/01591 | 3/1990 | WIPO . | |
| PCT/US90/01507 | 3/1990 | WIPO . | |

OTHER PUBLICATIONS

International Search Report, PCT/US92/11084, filed Dec. 12, 1992 (2 pages).

*Primary Examiner*—Brenda A. Lamb

*Attorney, Agent, or Firm*—Klarquist Sparkman Campbell Leigh & Whinston, LLP

[57] ABSTRACT

A system for coating discontinuous fibers with a liquid coating material uses a hopper/blender which entrains the fiber particles in a toroidal mass of moving fibers. The hopper/blender has an inverted conical section with an agitator assembly rotated therein. The agitator assembly has a base disc with tubular blades projecting outwardly therefrom into the conical section. Aft swept lifter blades relative to the direction of rotation are mounted to the agitator disc. A method of applying a liquid coating material to discontinuous fibers is also disclosed.

33 Claims, 6 Drawing Sheets

U.S. PATENT DOCUMENTS

| | | | |
|---|---|---|---|
| 3,494,992 | 2/1970 | Wiegand | 264/121 |
| 3,577,312 | 5/1971 | Videen et al. | 162/148 |
| 3,594,269 | 7/1971 | Clark | 162/57 |
| 3,616,002 | 11/1971 | Paquette et al. | 156/180 |
| 3,635,448 | 1/1972 | Okada | 366/314 |
| 3,638,917 | 2/1972 | Osten . | |
| 3,664,096 | 5/1972 | Le June | 366/325 |
| 3,671,296 | 6/1972 | Funakoshi et al. | 117/100 B |
| 3,672,945 | 6/1972 | Taylor | 427/214 |
| 3,673,021 | 6/1972 | Joa | 156/62.4 |
| 3,687,717 | 8/1972 | Philip | 118/303 |
| 3,687,749 | 8/1972 | Reinhall | 156/62.4 |
| 3,734,471 | 5/1973 | Engels | 259/6 |
| 3,752,733 | 8/1973 | Graham et al. . | |
| 3,765,971 | 10/1973 | Fleissner | 156/62.2 |
| 3,775,210 | 11/1973 | Paquette et al. | 156/181 |
| 3,791,783 | 2/1974 | Damon et al. | 425/82 |
| 3,836,412 | 9/1974 | Boustany et al. | 156/62.2 |
| 3,850,601 | 11/1974 | Stapleford et al. | 428/220 |
| 3,901,236 | 8/1975 | Assarsson et al. | 128/28 |
| 3,914,498 | 10/1975 | Videen | 428/290 |
| 3,916,825 | 11/1975 | Schnitzler et al. | 118/303 |
| 3,942,729 | 5/1976 | Fredricksson | 241/38 |
| 3,967,005 | 6/1976 | Cattaneo | 407/202 |
| 3,974,307 | 8/1976 | Bowen | 427/212 |
| 3,991,225 | 11/1976 | Blouin | 427/3 |
| 3,992,558 | 11/1976 | Smith-Johannsen et al. | 427/213 |
| 4,006,706 | 2/1977 | Lodige et al. | 118/303 |
| 4,006,887 | 2/1977 | Engels | 259/9 |
| 4,009,313 | 2/1977 | Crawford et al. | 428/290 |
| 4,010,308 | 3/1977 | Wiczer . | |
| 4,015,830 | 4/1977 | Lodige et al. | 259/25 |
| 4,039,645 | 8/1977 | Coyle | 264/118 |
| 4,100,328 | 7/1978 | Gallagher | 428/407 |
| 4,111,730 | 9/1978 | Balatinecz | 156/622 |
| 4,129,132 | 12/1978 | Butterworth . | |
| 4,141,316 | 2/1979 | Grun | 118/303 |
| 4,143,975 | 5/1979 | Lodige et al. | 366/147 |
| 4,153,488 | 5/1979 | Wiegand | 156/62.2 |
| 4,160,059 | 7/1979 | Samejima | 428/288 |
| 4,168,919 | 9/1979 | Rosen et al. | 366/173 |
| 4,171,165 | 10/1979 | Card | 366/325 |
| 4,183,997 | 1/1980 | Stofke | 428/326 |
| 4,187,342 | 2/1980 | Holst et al. | 428/283 |
| 4,188,130 | 2/1980 | Engels | 366/228 |
| 4,191,224 | 3/1980 | Bontrager et al. | 141/100 |
| 4,193,700 | 3/1980 | Wirz | 366/156 |
| 4,237,814 | 12/1980 | Ormós et al. | 118/303 |
| 4,241,133 | 12/1980 | Lund et al. | 428/326 |
| 4,241,692 | 12/1980 | Van Hijfte et al. | 118/303 |
| 4,242,241 | 12/1980 | Rosen et al. | 260/17.2 |
| 4,252,844 | 2/1981 | Nesgood et al. | 427/213 |
| 4,261,943 | 4/1981 | McCorsley, III . | |
| 4,297,253 | 10/1981 | Sorbier | 260/17.3 |
| 4,302,488 | 11/1981 | Lowi, Jr. | 427/212 |
| 4,310,124 | 1/1982 | Schwing et al. | 366/325 |
| 4,320,166 | 3/1982 | Endo et al. | 428/283 |
| 4,320,715 | 3/1982 | Maloney et al. | 118/303 |
| 4,323,625 | 4/1982 | Coran et al. | 428/361 |
| 4,337,722 | 7/1982 | Debayeaux et al. | 118/303 |
| 4,354,450 | 10/1982 | Nagahama et al. | 118/303 |
| 4,360,545 | 11/1982 | Maloney et al. . | |
| 4,364,992 | 12/1982 | Ito et al. . | |
| 4,370,945 | 2/1983 | Beckschulte et al. | 118/303 |
| 4,379,194 | 4/1983 | Clarke et al. | 428/203 |
| 4,379,196 | 4/1983 | Hunt | 428/196 |
| 4,392,908 | 7/1983 | Dehnel | 427/194 |
| 4,404,250 | 9/1983 | Clarke et al. | 428/220 |
| 4,407,771 | 10/1983 | Betzner et al. | 264/115 |
| 4,414,267 | 11/1983 | Coran et al. | 428/361 |
| 4,418,676 | 12/1983 | Paquette et al. | 156/181 |
| 4,424,247 | 1/1984 | Erickson | 428/138 |
| 4,425,126 | 1/1984 | Butterworth . | |
| 4,426,417 | 1/1984 | Meitner et al. | 428/195 |
| 4,428,843 | 1/1984 | Cowan et al. . | |
| 4,429,001 | 1/1984 | Kolpin et al. . | |
| 4,430,003 | 2/1984 | Beattie et al. | 366/173 |
| 4,435,234 | 3/1984 | Hunt | 156/62.4 |
| 4,439,489 | 3/1984 | Johnson et al. | 428/404 |
| 4,444,810 | 4/1984 | Huttlin | 427/212 |
| 4,457,978 | 7/1984 | Wawzonek | 524/14 |
| 4,465,017 | 8/1984 | Simmons | 118/418 |
| 4,468,264 | 8/1984 | Clarke et al. | 156/62.2 |
| 4,469,746 | 9/1984 | Weisman et al. | 428/289 |
| 4,478,896 | 10/1984 | Barnes et al. | 427/421 |
| 4,486,501 | 12/1984 | Holbek | 428/375 |
| 4,487,365 | 12/1984 | Sperber | 239/8 |
| 4,492,729 | 1/1985 | Bannerman et al. . | |
| 4,500,384 | 2/1985 | Tomioka et al. | 156/290 |
| 4,510,184 | 4/1985 | Winkler et al. | 427/212 |
| 4,514,255 | 4/1985 | Maxwell et al. | 162/9 |
| 4,516,524 | 5/1985 | McClellan et al. | 117/683 |
| 4,547,403 | 10/1985 | Smith | 427/196 |
| 4,559,050 | 12/1985 | Iskra | 604/368 |
| 4,572,100 | 2/1986 | Schluter | 118/303 |
| 4,572,845 | 2/1986 | Christen | 427/212 |
| 4,584,357 | 4/1986 | Harding . | |
| 4,592,302 | 6/1986 | Motoyama et al. | 118/303 |
| 4,596,737 | 6/1986 | Werbowy et al. | 428/228 |
| 4,600,462 | 7/1986 | Watt | 156/278 |
| 4,610,678 | 9/1986 | Weisman et al. | 604/368 |
| 4,615,689 | 10/1986 | Murray et al. | 493/51 |
| 4,647,324 | 3/1989 | Mtangi et al. | 156/62.2 |
| 4,648,920 | 3/1987 | Sperber | 156/62.2 |
| 4,656,056 | 4/1987 | Leuenberger | 427/213 |
| 4,664,969 | 5/1987 | Rossi et al. | 428/284 |
| 4,673,402 | 6/1987 | Weisman et al. | 604/368 |
| 4,673,594 | 6/1987 | Smith | 427/196 |
| 4,676,784 | 6/1987 | Erdman et al. | 604/368 |
| 4,689,249 | 8/1987 | Thygesen | 427/180 |
| 4,724,794 | 2/1988 | Itoh | 118/303 |
| 4,746,547 | 5/1988 | Brown et al. | 427/213 |
| 4,749,595 | 6/1988 | Honda et al. | 427/213 |
| 4,758,466 | 7/1988 | Dabi et al. . | |
| 4,772,443 | 9/1988 | Thornton et al. | 264/119 |
| 4,788,080 | 11/1988 | Hojo et al. | 427/204 |
| 4,806,598 | 2/1989 | Morman | 525/63 |
| 4,818,587 | 4/1989 | Ejima et al. | 428/198 |
| 4,818,599 | 4/1989 | Marcus | 428/288 |
| 4,818,613 | 4/1989 | Ohtani et al. | 428/396 |
| 4,838,704 | 6/1989 | Carver | 366/325 |
| 4,872,870 | 10/1989 | Jackson | 604/366 |
| 4,900,377 | 2/1990 | Redford et al. | 156/62.2 |
| 4,921,674 | 5/1990 | Enos | 118/303 |
| 4,937,100 | 6/1990 | Lanters et al. | 427/212 |
| 4,979,318 | 12/1990 | Brooker et al. | 428/283 |
| 5,057,166 | 10/1991 | Young, Sr. et al. . | |
| 5,064,689 | 11/1991 | Young, Sr. et al. | 427/202 |

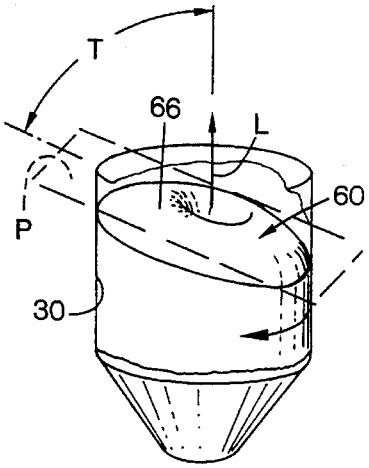
FIG. 2
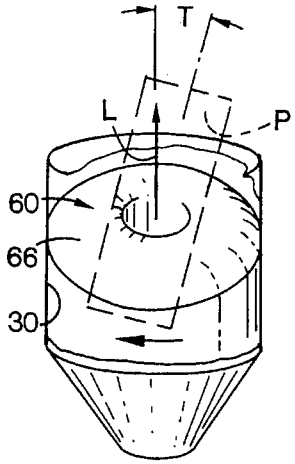
FIG. 3
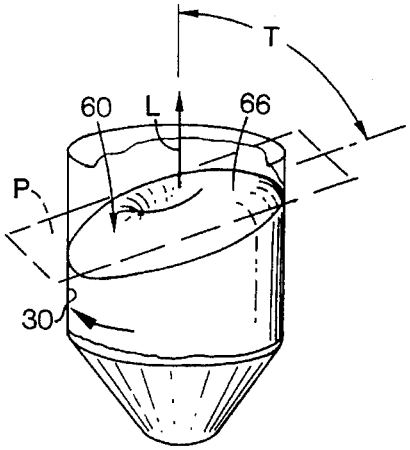
FIG. 4
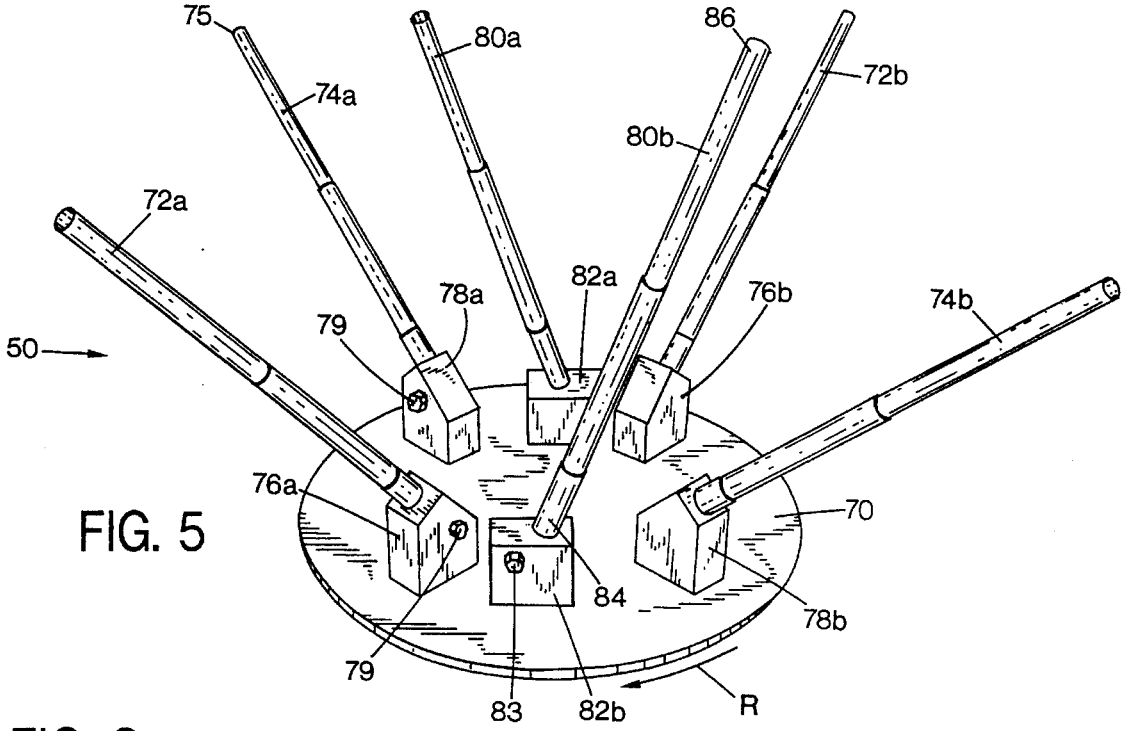
FIG. 5
FIG. 8
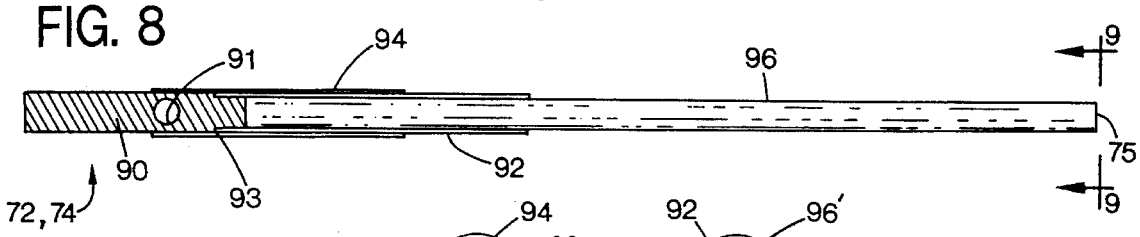
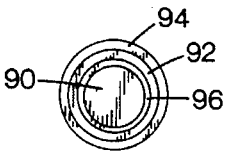
FIG. 9
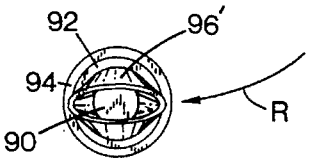
FIG. 10

HOPPER BLENDER SYSTEM AND METHOD FOR COATING FIBERS

This application is a continuation of application Ser. No. 07/812,054, filed on Dec. 17, 1991, now abandoned.

BACKGROUND OF THE INVENTION

The present invention relates generally to a system for coating discontinuous fibers with a liquid coating material, and more particularly to an improved apparatus and method of applying a liquid coating material to discontinuous fibers to provide coated fibers.

A number of techniques for applying binders to webs of fibers are known, and are disclosed in U.S. patent application Ser. Nos. 07/673,685 now abandoned, and 07/673,899 now U.S. Pat. No. 5,432,000, each of which are entitled "Binder Coated Discontinuous Fibers with Adhered Particulate Materials," each of which are continuation-in-part applications of U.S. patent application Ser. Nos. 07/326,188 now U.S. Pat. No. 5,230,959, entitled "A Coated Fiber Product With Super Absorbent Particles;" 07/326,181 now abandoned, entitled "A Natural Fiber Product Coated With A Thermoset Binder Material;" and 07/326,196 now abandoned, entitled "A Natural Fiber Product With A Thermoplastic Binder Material," and each of these five patent applications are commonly owned by the assignee of the present invention and are hereby incorporated by reference herein.

Other blending/mixing operations have been used in other applications. One such blending operation is known as blow line blending. During blow line blending, binder mixing and some deagglomeration of fibers may occur during "the blow" cycle. However, the blow cycle offers only one opportunity for such mixing and deagglomeration to occur. Furthermore, control of the coating and the production of bulk fibers which are substantially continuously coated is not available in blow line blending. Thus, blow line blending has many disadvantages rendering it undesirable for the coating of fibers.

Another known blending/mixing operation is performed during the manufacture of particle board and flake board. However, the low speed mixing used during the particle board/flake board manufacture has little or no deagglomeration characteristic. In most composite particle or flake boards which are pressed together after mixing, deagglomeration simply is not a concern. There are some high speed mixers used in the particle board/flake board industry, but these mixers have inadequate mixing rates and inadequate deagglomeration capabilities to suitably continuously coat fibers. Furthermore, these systems tend to produce agglomerated fibers and not individual fibers.

Another blending/mixing operation is known as slurry or liquid state mixing. In liquid state mixing, however, fiber agglomeration takes place. Furthermore, the majority of commercial available mixers are designed for liquid state mixing, and thus, the problem of deagglomeration is simply not addressed by mixer vendors.

In the past, fluidized beds have been used for coating various types of particles, such as pills and granules. However, such coating methods are not understood to have been considered for coating discontinuous fibers, perhaps because it would be anticipated that such fibers do not readily fluidize, would flocculate and would agglomerate during the coating process.

Other coated fiber production methods employ variations on traditional batch methods. For example, current in-line processes are duct work oriented, and disadvantageously require space consuming relatively long ducts or recirculating duct work systems. These in-line methods also require implementation of in-line break-up methods to correctly form acceptable coated fibers.

Thus, a need exists for an improved fiber hopper/blender system and method for applying a liquid coating material to discontinuous fibers, which is directed toward overcoming the above limitations and disadvantages of the prior art.

SUMMARY OF THE INVENTION

According to one aspect of the present invention, an improved method and apparatus is provided for applying a liquid coating material to a mass of discontinuous fibers so as to at least partially coat the fibers with the coating material. The method includes the step of entraining the fibers so as to circulate in a chamber. The chamber may be coupled to plural such chambers operated in series, or one or more such chambers operating in parallel, or in series/parallel configurations. In an applying step, the liquid coating material is applied to the moving entrained fibers in the chamber or chambers to at least partially coat the fibers with the coating material.

In an illustrated embodiment, the method further includes the step of mixing the fibers and confining the entrained fibers in a chamber so as to form a mass of entrained fibers. On average, the entrained fibers generally take on a toroidal shape with the mass of fibers being oriented generally about an upright axis. The fibers are mixed at a high mixing rate so as to travel generally upwardly along the outer boundary of the entrained mass of fibers and downwardly adjacent to the upright axis. The toroidal mass of entrained fibers has an upper surface, and the mixing and confining step is achieved such that the upper surface generally intersects a plane skewed or tilted with respect to horizontal. The method may also include a step of moving the fibers such that the plane revolves about the upright axis. It should be noted that the toroidal shape and upper surface is not well defined due to the fact that individual fibers travel both above and below the surface, but on average the mass of fibers appears to follow this toroidal flow pattern. In a further aspect of this method, the entrained mass of fibers may be continuously coated with the coating material. As a further step, the applied liquid coating material may be a binder.

According to another aspect of the present invention, an apparatus is provided for applying a liquid coating material to discontinuous fibers. The apparatus includes an upright chamber having a fiber receiving inlet through which the fibers to be treated are delivered to the chamber. The upright chamber also has a fiber delivery outlet from which the fibers with applied liquid coating material are removed from the chamber. The chamber has an inverted conical section with a base and mixing blades oriented for rotation about an upright axis. That is, the chamber has a section which preferably is frustoconical with its tapered end (the end of narrowest gross sectional dimension) inverted, meaning below the end of widest cross sectional dimension. The apparatus also includes a rotatable blade support positioned within the chamber at the base. A motor is coupled to the blade support for rotating the blade support. Plural elongated mixing blades each have one end mounted to the blade support. A distal end of each elongated blade projects outwardly from the blade support and into the conical section of the chamber. In addition, the distal ends of the mixing blades are positioned to extend radially outwardly from the axis of rotation of the blade support. A coating material applier is positioned to direct droplets of liquid coating material into the chamber. In this manner, rotation of the blade support rotates the blades to thereby entrain fibers within the chamber. The droplets of coating material are applied to the entrained fibers to provide at least a partial coating of the coating material on the entrained fibers.

As another feature of the illustrated embodiment, the blades may also include one or more lifting blades oriented to lift the fibers upwardly in the chamber. The lifting blades are preferably directed with the distal end lagging in the direction of rotation of the blade support and tangential to a right cylinder projecting upwardly from the blade support.

In an illustrated embodiment, the chamber has an upright longitudinal axis, and the blade support is positioned for rotation about the chamber longitudinal axis. The chamber may have an upper cylindrical section positioned above the inverted conical section, with the height of the conical section being from about 40% to about 60% of the diameter of the upper cylindrical section.

In another illustrated embodiment, the chamber may have plural inverted conical sections, each having a respective base, with the conical sections being coupled together such that fiber passes through the chamber to the successive conical sections. A rotatable blade support may be provided at the base of each conical section, with a motor supplied for rotating each blade support. The blades may be as described above, with a coating material applier positioned to direct droplets of coating material into each conical section. The fiber is passed from conical section to conical section, with the droplets of coating material applied to the entrained fibers in each conical section providing at least a partial coating of the coating material on the entrained fibers. Plural chamber sections may be provided and interconnected by a conduit, with each chamber section including at least one conical section.

In a further illustrated embodiment, the distal ends of the blades may be rotated at from about 4,700 to about 9,000 feet per minute. The blade support may be rotated from about 1,200 to about 1,800 revolutions per minute. Each blade support preferably has at least four mixing blades, with the distal ends of the blades being positioned a predetermined distance from the walls of the conical section. The mixing blades are preferably oriented at a blade angle of about 40° to about 60° relative to the horizontal, with 45° being a more preferred orientation. The lifting blades, if used, are preferably oriented at an angle of from about 45° to about 80° from horizontal, with 70° being a more preferred orientation. These blades may be readily removable for replacement as desired.

An overall object of the present invention is to provide an improved method and apparatus for coating discontinuous fibers.

A further object of the present invention is to provide an improved hopper/blender and process for coated fiber manufacture, including both batch and continuous processes.

An additional object of the present invention is to provide an improved hopper/blender having a simplified blade geometry which reduces maintenance and cleaning requirements, which causes less damage to fibers, and which is safer to work around for both maintenance and operation crews.

Another object of the present invention is to provide an improved hopper/blender for coated fiber production which has a blade configuration and containment geometry capable of compensating for varying masses of discontinuous fibers to be coated.

Still another object of the present invention is to provide an improved method and apparatus for applying a liquid coating to discontinuous fibers over a wide range of speeds, over wide variations in fiber density, over various changes in moisture content, and at various loadings of air-to-fiber mixture ratios.

Another object of the invention is to provide an improved apparatus which readily entrains fiber without the need for auxiliary equipment from stand-still starting conditions to full design speed operation conditions and over a wide range of fiber mass loadings within the apparatus.

The present invention relates to the above features and objects individually as well as collectively. These and other objects, features and advantages of the present invention will become apparent to those skilled in the art from the following description and drawings.

BRIEF DESCRIPTION OF THE DRAWINGS

FIGS. 2–4 are reduced scale fragmentary perspective views of a portion of the hopper/blender of FIG. 1 schematically illustrating the general fiber flow patterns therein;

FIG. 5 is a perspective view of one form of an agitator assembly of the present invention;

FIG. 8 is a longitudinal cross-sectional view of one form of a blade of the present invention;

FIG. 9 is an end view of the blade of FIG. 8 taken along lines 9—9 thereof;

FIG. 10 is an alternate embodiment of the blade shown in FIG. 9;

DETAILED DESCRIPTION OF THE PREFERRED EMBODIMENTS

Figure 1:
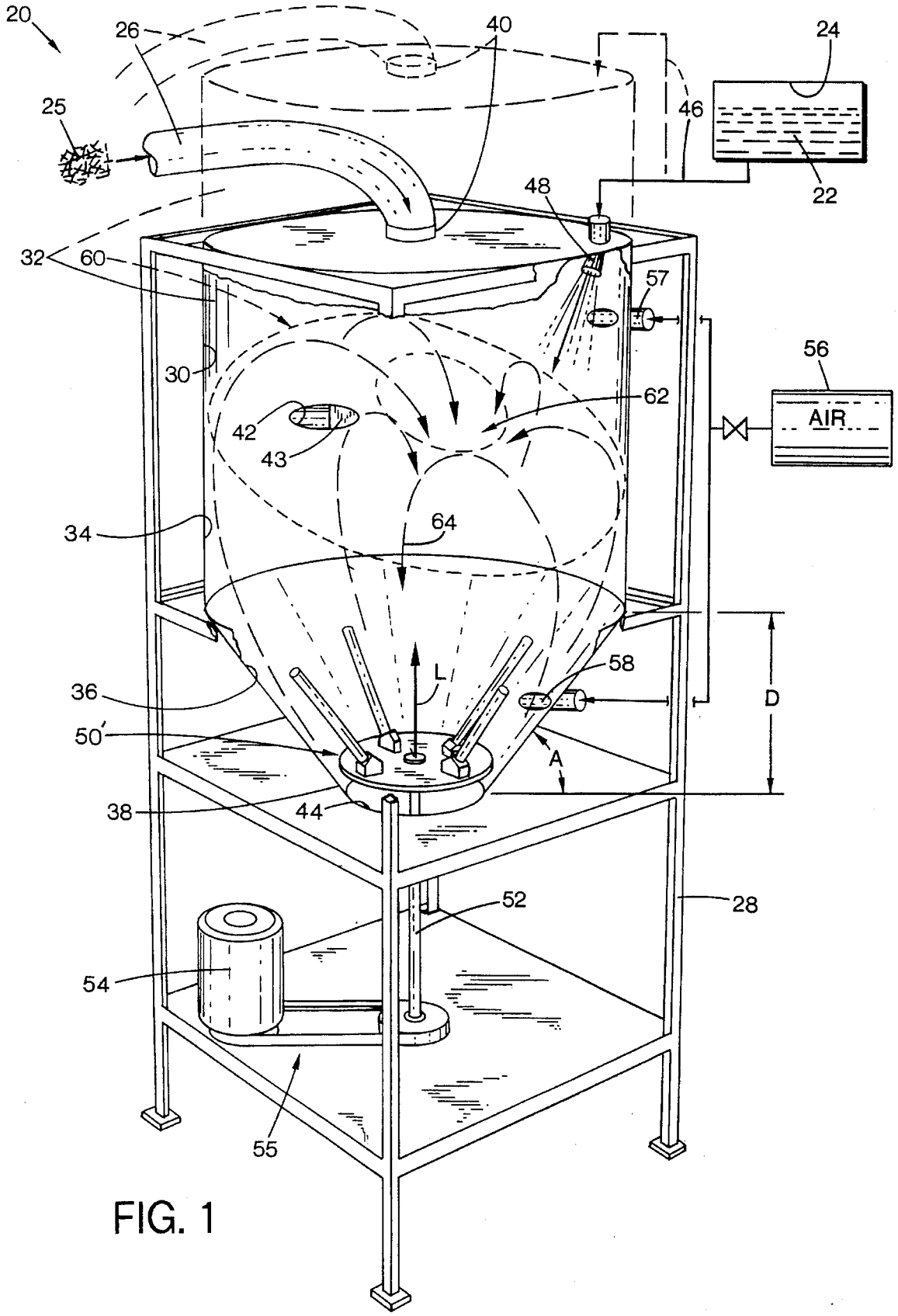
FIG. 1 is a partially schematic fragmentary perspective view of one form of a hopper/blender apparatus of the present invention.

The present invention is applicable to treated discontinuous synthetic and natural fibers. The term natural fibers refers to fibers which are naturally occurring, as opposed to synthetic fibers. Non-cellulosic natural fibers are included, with chopped silk fibers and wool being specific examples. In addition, the term natural fibers includes cellulosic fibers such as wood pulp, bagasse, hemp, jute, rice, wheat, bamboo, corn, sisal, cotton, flax, kenaf, and the like and mixtures thereof. The term discontinuous fibers refers to fibers of a relatively short length in comparison to continuous fibers treated during an extrusion process used to produce such fibers. The term discontinuous fibers also includes fiber bundles. The term individual fibers refers to fibers that are comprised substantially of individual separated fibers with at most only a small amount of fiber bundles. Chopped or broken synthetic fibers also fall into the category of discontinuous fibers. Although not limited to any particular type of fiber, the synthetic fibers commonly are of polyethylene, polypropylene, acrylic, polyester, polyaramid (e.g. KEVLAR®), rayon and nylon. Discontinuous fibers of inorganic and organic materials, including cellulosic fibers, such as cellulose acetate, cellulose triacetate, etc., are also included. The natural fibers may likewise be of a wide variety of materials, such as mentioned previously. The fibers may be subjected to fibrillation, for example by mechanical or ultrasonic means to break the fibers into fibers of smaller cross sectional dimension and to disperse clumps or bundles of fiber prior to treatment.

Wood pulp fibers can be obtained from well-known chemical processes such as the Kraft and sulfite processes. Suitable starting materials for these processes include hardwood and softwood species, such as alder, pine, douglas fir, spruce and hemlock. Wood pulp fibers can also be obtained from mechanical processes, such as ground wood, refiner mechanical, thermomechanical, chemi-mechanical, and chemi-thermomechanical pulp processes. However, to the extent such processes produce fiber bundles as opposed to individually separated fibers or individual fibers, they are less preferred. However, treating fiber bundles is within the scope of the present invention. Recycled or secondary wood pulp fibers and bleached and unbleached wood pulp fibers can also be used. Details of the production of wood pulp fibers are well-known to those skilled in the art. These fibers are commercially available from a number of companies, including Weyerhaeuser Company, the assignee of the present patent application. Wood pulp fibers typically have an irregular or rough surface and, for this reason, are particularly difficult to coat on a substantially continuous basis.

For purposes of convenience, and not to be construed as a limitation, the following description proceeds with reference to the treatment of individual chemical wood pulp fibers. The treatment of individual fibers of other types and obtained by other methods, as well as the treatment of fiber bundles, can be accomplished in the same manner.

When relatively dry wood pulp fibers are being treated, that is fibers with less than about ten to twelve percent by weight moisture content, the lumen of such fibers is substantially collapsed. As a result, when binder materials, in particular latex binder materials, are applied to these relatively dry wood pulp fibers, penetration of the binder into the lumen is minimized. In comparison, relatively wet fibers tend to have open lumen through which binder materials can flow into the fiber in the event the fiber is immersed in the binder. Any binder that penetrates the lumen contributes less to the desired characteristics of the treated fiber than the binder which is present on the surface of the fiber. Therefore, when relatively dry wood pulp fibers are treated, less binder material is required to obtain the same effect than in the case where the fibers are relatively wet and the binder penetrates the lumen.

The fibers may be pretreated prior to the application of a binder to the fibers. This pretreatment may include physical treatment, such as subjecting the fibers to steam or chemical treatment, such as cross-linking the fibers. Although not to be construed as a limitation, examples of pretreating fibers include the application of fire retardants to the fibers, such as by spraying the fibers with fire retardant chemicals. Specific fire retardant chemicals include, by way of example, sodium borate/boric acid, urea, urea/phosphates, etc. In addition, the fibers may be pretreated with surfactants or other liquids, such as water or solvents, which modify the surface of the fibers. Sizing of fibers with sizing agents, such as starch, polymers and alkyl ketene dimer are yet other examples of possible fiber pretreatment. The fibers may also be pretreated in a way which increases their wettability. For example, natural fibers may be pretreated with a liquid sodium silicate, as by spraying the fibers with this material, for pretreatment purposes. Wettability of the surface of fibers is also improved by subjecting the fibers to a corona discharge pretreatment in which electrical current is discharged through the fibers in a conventional manner. In the case of both synthetic fibers and wood pulp fibers, corona discharge pretreatment results in oxygen functionality on the surface of the fibers, making them more wettable. The fibers may also be pretreated with conventional cross-linking materials and may be twisted or crimped, as desired. Pretreating cellulose fibers with chemicals which result in lignin or cellulose rich fiber surfaces may also be performed in a conventional manner. Also, pretreatment with materials such as silane enhances the adhesion between fibers and polymers or other substances. Bleaching processes, such as chlorine or ozone/oxygen bleaching may also be used in pretreating the fibers. In addition, the fibers may be pretreated, as by slurrying the fibers in baths containing antimicrobial solutions (such as solutions of antimicrobial particles as set forth below), fertilizers and pesticides, and/or fragrances and flavors, for release over time during the life of the fibers. Fibers pretreated with other chemicals, such as thermoplastic and thermoset resins, may also be used. Combinations of pretreatments may also be employed with the resulting pretreated fibers then being subjected to the application of the binder coating as explained below.

Binders used to treat the fibers broadly include substances which can be applied in liquid form to entrained fibers during treatment. These binder materials are preferably of the type which are capable of subsequently binding the fibers produced by the process to one another or to other fibers during the manufacture of webs and other products using the treated fibers. Most preferably these binders comprise organic polymer materials which may be heat fused or heat cured at elevated temperatures to bond the fibers when the fibers are used in manufacturing products. Also, in applications where solid particulate material is to be adhered to the fibers by the binder, the binder must be of a type which is suitable for this purpose.

Suitable binders include polymeric materials in the form of aqueous emulsions or solutions and nonaqueous solutions. Chitosan starches and waxes are also suitable binders. To prevent agglomeration of fibers during the treatment process, preferably the total liquid content of the treated fibers during treatment, including the moisture contributed by the binder together with the liquid content of the fibers (in the case of moisture containing fibers such as wood pulp), must be no more than about forty-five to fifty-five percent of the total weight, with a twenty-five to thirty-five percent moisture content being more typical. Assuming wood pulp is used as the fiber, the moisture contributed by the wood pulp can be higher, but is preferably less than about ten to twelve percent and more typically about six to eight percent. The remaining moisture or liquid is typically contributed by the binder. These polymer emulsions are typically referred to as "latexes." In the present application, the term "latex" refers very broadly to any aqueous emulsion of a polymeric material. The term solution means binders dissolved in water or other solvents, such as acetone or toluene. Polymeric materials used in binders in accordance with the present method can range from hard rigid types to those which are soft and rubbery. Moreover, these polymers may be either thermoplastic or thermosetting in nature. In the case of thermoplastic polymers, the polymers may be a material which remains permanently thermoplastic. Alternatively, such polymers may be of a type which is partially or fully cross-linkable, with or without an external catalyst, into a thermosetting type polymer. As a few specific examples, suitable thermoplastic binders can be made of the following materials:

ethylene vinyl alcohol
polyvinyl acetate
polyvinyl alcohol
acrylic
polyvinyl acetate acrylate
acrylates
polyvinyl dichloride
ethylene vinyl acetate
ethylene vinyl chloride
polyvinyl chloride
styrene
styrene acrylate
styrene/butadiene
styrene/acrylonitrile
butadiene/acrylonitrile
acrylonitrile/butadiene/styrene
ethylene acrylic acid
polyethylene
urethanes
polycarbonate
polyphenylene oxide
polypropylene
polyesters
polyimides In addition, a few specific examples of thermoset binders include those made of the following materials:

epoxy
phenolic
bismaleimide
polyimide
melamine/formaldehyde
polyester
urethanes
urea
urea/formaldehyde Wax, starch and chitosan are yet additional examples of suitable binders. However, although starch is a suitable binder for attaching particles to fibers, it has not been found to provide a substantially continuous coating on fibers.

More than one of these materials may be used to treat the discontinuous fibers. For example, a first coating or sheath of a thermoset material may be used followed by a second coating of a thermoplastic material. During subsequent use of the fibers to make products, the thermoplastic material may be heated to its softening or tack temperature without raising the thermoset material to its curing temperature. The remaining thermoset material permits subsequent heating of the fibers to cure the thermoset material during further processing. Alternatively, the thermoset material may be cured at the same time the thermoplastic material is heated by heating the fibers to the curing temperature of the thermoset with the thermoplastic material also being heated to its tack temperature.

Certain types of binders enhance the fire resistance of the treated fibers, and thereby of products made from these fibers. For example, polyvinyl chloride, polyvinyl dichloride, ethylene vinyl chloride and phenolic are fire retardant.

Surfactants may also be included in the liquid binder as desired. Other materials, such as colorants or dyes, may also be mixed with the liquid binder to impart desired characteristics to the treated fibers. If a water insoluble dye is included in the binder, the dye remains with the fibers, rather than leaching into aqueous solutions used, for example, in wet laying applications of the treated fibers. Also, dye would not leach from towels and other products made from these fibers when these products are used, for example, to wipe up liquids. Solid particulate materials, such as pigments, may also be mixed with the binder for simultaneous application with the binder. In this case, the particulate material is typically coated with the binder rather than having exposed uncoated surfaces when adhered to the fibers as explained below. Other liquid materials may also be mixed with the binder with the mixture still performing its function.

Materials other than binders may also be used to coat the fibers in whole or in part. Flame retardant materials and sizing materials are two specific examples.

In addition, one or more solid particulate materials may be adhered to the fibers to provide desired functional characteristics. The solid particulate materials are typically applied to a binder wetted surface of the fibers and are then adhered to the fibers by the binder as the binder dries.

In general, there are several parameters which are believed applicable to the selection of a suitable binder for binding a particulate to a fiber. The first parameter involves the proper functionality of the binder. In the case of particulate materials, such as super absorbent polymers and other polar, hydrophilic materials, proper functionality amounts to some functionality in the binder surface structure which is capable of hydrogen bonding to like functionalities on the surface of the particulate. Examples of such functionalities would include carboxyl groups, hydroxyl groups, amino groups and epoxides. In the case of non-polar, hydrophobic particles, proper functionality amounts to correspondingly non-polar hydrophobic portions on the binder surface structure, capable of manifesting a van der Waals' attraction to similar portions on the surface of the particles. In addition to functionality, another parameter believed important in the selection of a binder is that of good intermolecular contact between the binder and particles. That is, the functionalities of the first parameter are preferably juxtaposed in a manner close enough for significant interaction (hydrogen bonding or van der Waals' attraction) to occur. In this case, surfactants/emulsion systems of various latexes can be important in binding certain particulates. The surfactants serve to reduce contact angles between the binder and particulates, thus promoting or inhibiting the requisite intermolecular contact. As a third parameter in the selection of a binder, it is desirable that the binder be persistent. Water would be an excellent binder of super absorbent particles if it were persistent, as it satisfies the initial two criteria. However, water is a poor binder of super absorbent particles because it is not persistent. More persistent compounds (e.g. starch, PEG, HEC, CMC and so forth) with similar functionalities do make good super absorbent particle binders. The above parameters seem to also apply to thermoplastic and thermoset binders as well as other types of binders. Although the invention is not limited to a particular theory, selection of binders suitable for attaching specific particles to specific fibers may be made by keeping these parameters in mind. In this case, heat curing or heat fusing of the binder is not required to adhere the particles to the fibers.

Although not limited to specific materials, examples of suitable particulate materials include pigments and whiteners, such as inorganic pigments including titanium dioxide, ferrous oxide, PbO, AlO and $CaCO_3$ ($CaCO_3$ can also function as a filler in paper making applications and is not as white of a pigment as $TiO_2$) and organic pigments or colorants, such as Morton Hytherm Purple KI from Morton Thiokol Company of Chicago, Ill.; ultraviolet, infrared or other wave length blocking or inhibiting particulates, such as carbon blacks as an ultraviolet inhibitor and zirconium carbide as an infrared inhibitor; fire retardant materials, such as alumina trihydrate, antimony oxide, chlorinated and brominated compounds, pentabromochlorocyclohexane, 1,2-Bis(2,4,6-tribromophenoxy ethane, decabromodiphenyl oxide, molybdenum oxide and ammonium flyroborate, etc.; electrically conductive materials, such as metallic powders and carbon black; abrasive materials, such as ceramics, grit and metallic powders (with flint, garnet, sand, corundum, silicon carbide and stannous oxide, fly ash, stellite and silica being specific examples); acidular materials, such as clay, talc and mica, used as papermaking additives; oleophilic materials such as polynorbornene and fumed silica; hydrophobic materials; and hydrophilic materials, such as hydrophilic silica (e.g. silane treated foamed silica) and super absorbent particles; pesticides and insecticides, such as GUTHION™ (O,O-dimethyl S-4-0×0-123-benzotriazin-3-(4H)ylmethyl phosphorodithioate, etc.; fertilizers; seeds; antimicrobial particulates, such as broad spectrum antimicrobials (e.g. hypochlorites, perborates, quaternary ammonium compounds, bisulfites, peroxides, etc.), narrow spectrum antimicrobials (e.g. chloramphenacol, 1-[2,4-dichloro-β-(2,4-dichlorobenzyloxy) phenethyl]imidazole nitrate, 1-(o-chloro α,α-diphenyl benzyl)imidazole, etc.), antivirals, antimycotics, antibacterials, antirickettsials, antibiotics, biocides, biostats, etc., and mixtures thereof; molecular sieves, such as odor absorbing sieves (Abscents™, e.g. sodium alumino silicates), drying agents (molecular sieves, magnesium sulfate, sodium sulfate, etc. and activated carbon); zeolites, e.g. based upon alumino phosphates and which may be modified to have antimicrobial properties; acids and bases, for example to alter the pH of a hazardous spill (ammonium chloride, aluminum sulfate, calcium carbonate, sodium bicarbonate, etc.; fiber appearance modifiers, such as mica, phosphorescent compounds (e.g. luciferin/luciferase, zinc sulfide/manganese); microspheres, including microencapsulated particles comprising time release microspheres which may contain a variety of chemicals, such as fertilizers and perfumes; microsponges, with or without added chemicals for functionality purposes; odor absorbing, inhibiting and masking particles such as activated carbon and perfumes (e.g. anisyl alcohol, benzophanone, musk and Abscents™ mentioned above); fungicides (which may be broadly considered as an antimicrobial), such as misonazole nitrate and Captan™ (trichloromethythio-dicarboximides), etc.; electromagnetic absorbers/deadeners (e.g. Fe, Pb, Al, Ag, Au); flame enhancers, such as powdered magnesium; magnetizing particulate materials, such as iron oxides; heat release particles, such as PEG-1000 (polyethylene glycol) which may be used in handwarmers and which crystalize at room temperature; radioactive particle tracers or labels, such as Carbon 14 (which may for example be combined in a bandage to trace absorption of antimicrobials from the bandage into a user's body), sodium iodide, uranyl nitrate, thorium nitrate, etc., starch particles such as cationic size press starch, which can be a binder when wet and can serve as a biodegradable adhesive; granular polymer particulate materials, such as recycled thermoset or thermoplastic polymer particles, which may, for example, be used as a filler when attached to fibers; catalysts, such as finely divided platinum; radar reflective particles, such as metallic powders; radar absorbing particles, such as graphite and ferrites; sound deadening or absorbing particles, such as barium sulfate; antistatic particles, such as sulfonated polyaniline and electrically conductive particles (e.g. metal powders); hot melt adhesives, such as ethylene vinyl acetate (these particles may have either higher or lower melting points than heat fusible or curable binders if used to attach the particles to fibers); bulking agents, such as expanded or unexpanded microspheres, ground foams, hi-bulk silicas, etc.; lubricating (antifriction) particulates, such as graphite and TEFLON®; friction inducing particulates, such as rubber; powdered soaps, surfactants and degreasers, such as laundry detergent (e.g. sodium dodecyl sulfate); chitosan particles; pollutant filtering particles, such as polyethyleneimine as a powder or a particulate for formaldehyde filtering; sorbants, such as diatomaceous earth; a coagulant or blood clotting agents (such as incorporated into bandages) with calcium nitrate being one example; indicators, such as for indicating the presence of chemicals (e.g. phenolphthalein/bromothymol blue) and water (e.g. cobalt chloride); anesthetic or pain killing particles (such as incorporated into dressings) with acetaminophen and codeine being specific examples; desiccants, such as calcium sulfate; medicines and pharmaceuticals, such as cortisone (anti-inflammatory), DRAMAMINE®, nitroglycerine; chemical neutralizing particles, such as potassium permanganate for neutralizing formaldehyde; oxidizing agents, such as potassium permanganate; reducing agents, such as aluminum; fabric softeners, such as quaternary ammonium salts and cationic surfactants; nutrient particles, such as vitamins, with ascorbic acid being a specific example of such particles (which would also function as a food preservative); and blood anti-coagulants, such as heparin. Thus, the solid particulate materials are not limited to narrow categories. Furthermore, one or more of the above particles may be mixed as required. When mixed, multiple types of particles may be adhered to the same fibers. Alternatively, blends of fibers, each with one or more particle types may be used. Also, the specific examples listed in the categories identified above are by no means exhaustive nor are the identified particulate categories intended to be limiting. These fibers with attached particulate materials may be included in absorbent and other structures, such as filters and rigid structures, and may or may not be blended with other fibers (including wood pulp fibers) in such structures.

The super absorbent particulate materials are granular or powdered materials which have the ability to absorb liquids, including body fluids. These super absorbents are generally hydrophilic polymeric materials. Super absorbents are defined herein as materials which exhibit the ability to absorb large quantities of liquids, i.e. in excess of ten to fifteen parts of liquid per part thereof. These super absorbent materials generally fall into three classes, namely, starch graft copolymers, cross-linked carboxymethyl cellulose derivatives and modified hydrophilic polyacrylates. Without limiting the generality of the term super absorbent, examples of super absorbents include carboxylated cellulose, hydrolyzed acrylonitrile-grafted starch, acrylic acid derivative polymers, polyacrylonitrile derivatives, polyacrylamide type compounds, saponified vinyl acetate/methyl acrylate copolymers, and blood specific super absorbent particles (such as Tylose™ 3790 from Hoeschst-Celanese, Inc. of Portsmouth, Va.). Specific examples of super absorbent particles are marketed under the trademarks "Sanwet" (supplied by Sanyo Rasei Kogyo Kabushiki Kaisha) and "Sumika Gel" (supplied by Sumitomo Kagaku Kabushiki Kaisha).

An abrasive is a hard substance that, in particulate form, is capable of effecting a physical change in a surface, ranging from the removal of a thin film of tarnish to the cutting of heavy metal cross sections and cutting stone. Abrasives are used in scores of different abrasive products. The two principal categories of abrasives are: (1) natural abrasives, such as quartz, emery, Carborundum, garnet, tripoli, diatomaceous earth (diatomite), pumice, and diamond; and (2) synthetic abrasives, such as fused alumina, silicon carbide, boron nitride, metallic abrasives, and synthetic diamond.

Oleophilic materials are those capable of rapid wetting by oil while hydrophilic materials are those capable of rapid wetting by water.

Pigments or colorants can broadly be defined as being capable of re-emitting light of certain wavelengths while absorbing light of other wavelengths and which are used to impart color.

Electrically conductive materials are those which readily conduct electrical current.

In addition, fire retardant materials are those which reduce the flammability of the fibers to which they are attached. Preferably these materials are active fire retardants in that they chemically inhibit oxidation or they emit water or other fire suppressing substances when burned. Virtually any amount of binder material may be applied to the entrained fibers. However, it has been found that the application of binder must be at a minimum of about seven percent of the dry weight of the combined fibers and binder in order for the fibers to have a substantially continuous sheath or coating of the binder material. If the fibers lack a continuous coating, it becomes more difficult to adhere significant amounts of particulate material to the binder. In fact, a much higher percentage of binder than this minimum is preferably used to adhere particles to the fibers. Also, exposed portions of the core fiber, that is surface areas of the fiber not coated with the binder, lack the desired characteristics of the binder. For example, if a hydrophobic binder is used to cover a water absorbing cellulose material, failure to completely enclose the material with the coating leaves exposed surfaces of the fiber which can absorb water. Also, any uncoated areas on the fibers would not bond to other untreated fibers during subsequent heat bonding of the treated and untreated fibers.

The binder may be applied to provide a partial coating over the surface area of the fibers. However, in most applications it is preferred to provide a coating over a substantial majority of the surface area, meaning at least about eighty percent of the surface area of the individual fibers. More typically, the fibers are substantially continuously coated with a continuous binder coating over substantially the entire surface (at least about ninety-five percent of the surface area) of the individual fibers. Also, in many cases virtually all of the surface area of the individual fibers is continuously coated, meaning that the surface coating is an unbroken and void free, or at the most has a few voids of less than the diameter of a fiber.

Also, binder may be applied so that a substantial majority of the fibers, that is at least eighty percent of the fibers: (a) have a substantial majority of their surface area coated; (b) a substantially continuous coating; or (c) have virtually their entire surface continuously coated. The remaining fibers typically have varying degrees of coating ranging from discrete patches of coating to a major portion of their surface (fifty percent or more) being continuously coated. Variations occur due to the type of binder being applied, the loading of the binder, and the fact that not all of the fibers receive the complete treatment. Also, substantially all (at least about ninety-five percent) of the individual fibers and fiber bundles being treated in bulk have been produced with coatings falling into the above three categories. Of course, for many applications it is desirable that substantially all of the fibers of the bulk fibers being produced have a substantially continuous coating or virtually their entire surface continuously coated because, in this case, the characteristics of the binder (as opposed to exposed fiber surfaces) controls the properties of the fibers. It has also been found that binder loading levels of approximately about seven percent of the combined weight of the binder and fiber results in fibers a substantial majority of which, and more typically substantially all of which, have a substantially continuous coating.

It has also been found that, with a binder concentration of about ten percent by dry weight of the weight of the fiber and binder combination, the fibers, when heat fused, will bond somewhat strongly to other fibers coated in a similar manner, but less strongly to untreated fibers. The resulting bond strength is similar to the strength achieved when fibers coated with a forty percent by dry weight binder amount are mixed with untreated fibers in a ratio of one part treated fiber to three parts untreated fiber. A binder concentration by dry weight of the combined binder and fibers of from thirty percent to fifty percent has proven extremely suitable for use in mixing with other fibers, heat bonding, and use in forming products such as absorbent pads.

FIG. 1 illustrates an apparatus, such as a hopper/blender 20, for applying a liquid coating material 22 stored in reservoir 24 to a plurality of discontinuous fibers 25 delivered to the hopper blender through passageway 26. The hopper/blender 20 includes a frame 28 for supporting an upright chamber 30, defined by the walls of tank 32, which may be extendable as shown in dashed lines to increase the volume of chamber 30. The chamber 30 has an optional upper cylindrical section 34 joining a lower inverted conical section or cone 36 having a base 38. Tables 1–4 describe the specifications and parameters for two prototype blenders which were built in accordance with the apparatus, and tested in accordance with the method, described herein.

TABLE I

Specifications of the Prototype Blenders:

| | Small Blender | Large Blender |
|---|---|---|
| Nominal design capacity | 0.5 kg fluff | 3.5 kg fluff |
| Top Diameter | 25" | 48" |
| Cone Angle | 60° | 50° |
| Base Diameter | 6–8" | 11" |
| Blade tip diameter | 15" | 32.5" |
| Blade Length | 10" | 16" |
| Horsepower at drive | 0.5, 1, 5 | 10 |
| Max rpm | 1800 | 1500 |
| Volume (nominal) | 8.5 $ft^3$ | 50 $ft^3$ |

TABLE 2

| PARAMETER RANGES | |
|---|---|
| Variable | Range Tested |
| Speed (small blender) | 0–1800 rpm |
| Tip Speed | 0–10,000 ft/min |
| Hopper Cone Angle | 0,45,50,60,70,80° from horizontal |
| Blade Angle | 40–90° from horizontal |
| Capacity | 20–150 gm/ft$^3$ |
| Blade Length | 50–90% cone height |
| Number of Blades | 3–1° |
| Spray rate | 0.2–10 liters/min. kg. |
| Cylindrical Height | 20–38" |
| Depth of Cone | 0–70% of top diameter |

TABLE 3

| PARAMETER RANGES | |
|---|---|
| Variable | Preferred Range |
| Speed (small blender) | 1200–1800 rpm |
| Tip Speed | 4700–9000 ft/min |
| Hopper Cone Angle | 45–60° from horizontal |
| Blade Angle | 40–60° from horizontal |
| Capacity | 50–90 gm/ft$^3$ |
| Blade Length | 60–70% cone height |
| Number of Blades | 4–6 |
| Spray Rate | 0.5–5 liters/min. kg. |
| Cylindrical Height | 20–30" (insensitive) |
| Depth of Cone | 40–60% of top diameter |

TABLE 4

| Variable Parameters | Preferred Operating |
|---|---|
| Speed (small blender) | 1400–1800 rpm |
| Tip Speed | 6000–9000 ft/min |
| Hopper Cone Angle | 45° from horizontal |
| Blade Angle | 45° from horizontal |
| Capacity | 80 gm/ft$^3$ |
| Blade Length | 65% cone height |
| Number of Blades | 6 (+?) |
| Spray Rate | 0.5–1.0 liters/min. kg. |
| Cylindrical Height | Pending nominal size |
| Depth of Cone | 50% of top diameter |

Referring to Table 1, two prototype blenders were constructed and tested, with one being referred to as "the small blender" having an estimated volume of 8.5 cubic feet, and a "large blender" having an estimated volume of 50 cubic feet. The small blender was fashioned to have a nominal design capacity of 0.5 Kg of fluff or fibers 25, and the large blender for 3.5 Kg of fluff or fibers. The capacity of chamber 30 tested was 20–150 grams of fiber (dry uncoated fibers, dry meaning less than about 10% w/w moisture) per cubic foot, with a preferred capacity of 50–90 grams of fiber (dry uncoated fibers) per cubic foot, and a most preferred operating capacity of 80 grams (dry uncoated fibers) per cubic foot. Other specifications for the tested blenders are shown in Table 1, and ranges of the various parameters tested for the small blender are shown in Table 2, with the "preferred" ranges being shown in Table 3, and the most preferred operating ranges being shown in Table 4. Blade tip speed was tested over the range shown. At higher mass loading rates, higher tip speeds and maintenance of tip speeds is important to maintain desirable flow patterns. Larger batch sizes, higher liquid content, higher binder addition, and increased particulate mass all require increased blade speeds (and correspondingly more power) to maintain adequate mixing and deagglomeration.

The height of the cylindrical section 34 tested ranged 20–38 inches, with 20–30 inches being a preferred height. The diameter of the cylindrical section 34 was 26 inches for the small blender, and 48 inches for the large blender. The diameter of base 38 for the small blender ranged from 6 to 8 inches, while the base diameter for the large blender was 11 inches.

The depth of the cone section 36 tested ranged between 0 and 70% of the top diameter, which in the illustrated embodiment equals the diameter of the cylindrical section 34. A preferred range for the depth of the cone section is 40–60%, with a most preferred operating depth being 50% of the top diameter. The tested values of hopper cone angle A (shown in FIG. 1), that is, the angle of the walls of conical section 36 with respect to the horizontal, were 0°, 45°, 50°, 60°, 70°, and 80°. A preferred range for the hopper cone angle A is 45°–60°, with a most preferred operating value being 45°. The prototype small blender was constructed with a cone angle of 60°, and the large blender with a cone angle of 50°. Adequate mixing can be achieved at the higher cone angles of the range tested. Larger volumes, capacities and production rates were achievable between approximately 40°–60°.

The upright chamber 30 has a fiber receiving inlet 40 in communication with passageway 26 to receive the fibers 25 which are to be treated. The inlet 40 may be centrally located to an upper surface of tank 32, or at some other location (not shown) preferably near the upper portion of the chamber 30. Fiber receiving can also be via storage bins or similar delivery devices. The chamber 30 also has a fiber delivery outlet, such as an upper fiber delivery outlet 42, selectively closable by gate valve 43, located in a sidewall of the upright chamber 30. Alternatively, a lower fiber delivery outlet 44 may be provided at the chamber base 38 (shown schematically in FIG. 1, with outlet ductwork omitted for clarity).

The liquid coating material 22 may be delivered from reservoir 24 through conventional piping or ductwork 46 to a coating material applier or liquid applicator, such as a nozzle assembly (not shown), a plurality of nozzles (not shown) or a spray nozzle 48. The spray nozzle 48 is commercially available and produces a fine mist of droplets. Typically, such nozzles provide a fan spray as shown. Any suitable nozzles may be used, but it is desirable that the nozzles not produce a continuous stream of liquid material 22, but instead produce droplets or a mist of such material. The tested spray rate ranged from 0.2 liters/min.kg. to 10 liters/min.kg. Best coating is achieved with spray droplets having a MVD (Median Volume Diameter) between about 10–400 Microns. Such sprays are easily attainable with air-atomizing nozzles such as those made by Spraying Systems Company (Wheaton, Ill.) or by other commercially available nozzles.

A rotatable agitator assembly 50' is rotatably mounted at the chamber base 38 by shaft 52. It is apparent that additional bearing assemblies may be mounted at the chamber base 38 or therebelow to provide additional support for the agitator assembly 50' and shaft 52, although such additional bearing assemblies have been omitted from FIG. 1 for clarity. The agitator assembly 50' may be rotated by a motor 54 coupled with shaft 52 by, for instance, a pulley and belt assembly 55, or by a direct drive coupling (not shown). Referring to Tables 1–4 for the prototype units, horsepowers of 0.5, 1.0 and 5.0 were used in the small blender embodiment for motor 54, and a 10.0 horsepower motor was used for the large blender embodiment. The speeds tested ranged from 0 to 1,800 rpm, with a preferred operating speed of 1,200–1,800 rpm, and a likely operating range of 1,400–1, 800 rpm for the small blender. The large blender was tested at a speed of 1,200 rpm. These operating speeds were chosen to give tip speeds in the ranges listed above.

In the illustrated embodiment, the agitator assembly 50' rotates about a longitudinal axis L, which is preferably vertical and preferably coaxial with the longitudinal axis of both the cylindrical section 34 and the conical section 36. However, in some applications it may be desirable to have the agitator assembly 50' rotate about an axis other than one coaxial with the longitudinal axis of the chamber 30 to provide entrainment patterns alternate to those described further below. Furthermore, the chamber 30 may include only a conical section such as 36, although the upright cylindrical section 34 advantageously conserves floor space within a manufacturing facility while providing excellent performance. Moreover, while the illustrated horizontal cross section of chamber 30 is circular, it is apparent that the chamber 30 may have a transverse cross section of other shapes, with smooth shapes such as an elliptical shape being preferred. However, irregular shaped cross sections, such as octagonal, would provide suitable performance. When such alternate shapes are used, it would be preferable to equip the upright chamber 30 with smooth interior surfaces or directing vanes to reduce the production of any undesirable eddy currents within the flow pattern.

Extra air may also be added to the chamber 30 from a source 56 injecting air through an entry port or manifold 57 near the top of the upright chamber 30 or through a lower air entry port or manifold 58 near the bottom of the chamber 30. Note that the locations of the air inlet ports or manifolds 57 and 58 are merely shown schematically in FIG. 1, and may have other desired locations and/or configurations (not shown). The addition of auxiliary air from supply 56, whether through the upper inlet 57 or the lower inlet 58, dramatically improves mixing performance at a given speed of the agitator assembly 50'. Such airflow through the mixing pattern acts to reduce the apparent viscosity of the multi-phase mixture. Thus, the power requirements of motor 54 are reduced with this introduction of air from source 56, which enhances the overall efficiency of the hopper/blender 20.

Using the agitator assembly 50', fibers 25 entering chamber 50 become an entrained mass of moving fibers having a tumbling or toroidal flow pattern, indicated generally at 60. This toroidal flow pattern 60 comprises fibers moving upwardly along the walls of chamber 30 and downwardly through a center portion 62 of the toroidal flow pattern, as indicated by the dashed flow arrows in FIG. 1, such as arrow 64. The flow pattern 60 within chamber 30 is best observed by adding small quantities of dyed tracer fibers, that is, small quantities of intensely dyed fibers, with white fluff fibers 25.

Referring to FIGS. 2–4, the toroidal flow pattern 60 is shown schematically to have an upper surface 66 substantially intersecting a plane P. In practice, individual fibers flow both above and below the plane, but the average fiber motion generally fits this flow pattern description. The upper surface 64 of the toroidal flow pattern 60 is tilted or skewed with respect to the upright axis L by a tilt angle T. This tilt angle T may vary during operation, for example by: adjusting the various mechanical features of the chamber 30 and agitator assembly 50'; varying the introduction of air 56 into the chamber; the spraying by nozzle 48 of the liquid coating material 22; by varying the placement of the fiber inlet 40; the fiber delivery outlets 42 or 44, as well as varying the types of fibers 25; and their flow rate, moisture content, size, and the like. Furthermore, the upper surface 66 of the toroidal pattern 60 may rotate about the upright axis L as shown by a comparison of FIGS. 2, 3 and 4, where the plane P is shown rotating with respect to the axis L. During this rotation of the upper surface 60, the angle of tilt T may remain constant or may vary, either in an oscillatory manner or in a random fashion.

Figure 6:
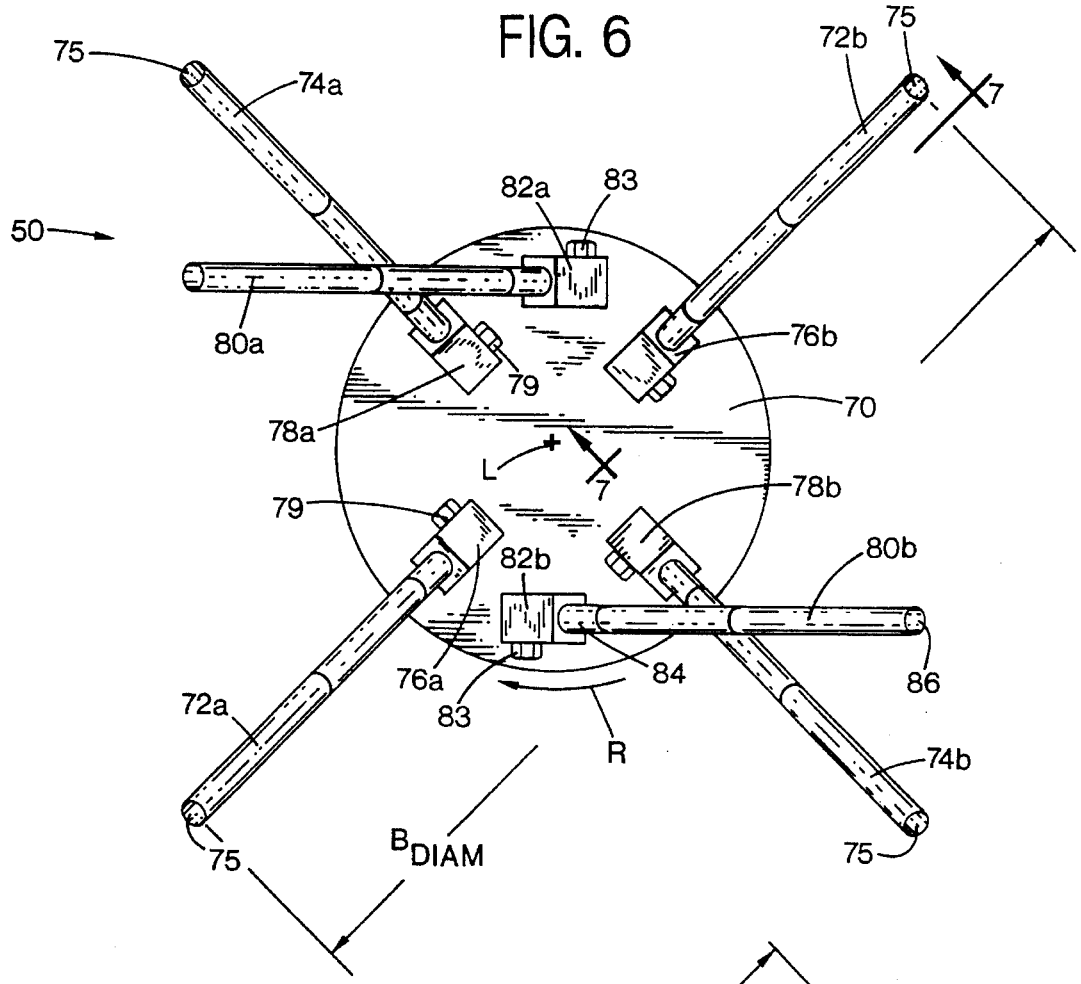
FIG. 6 is a top plan view of the agitator assembly of FIG. 5.
Figure 7:
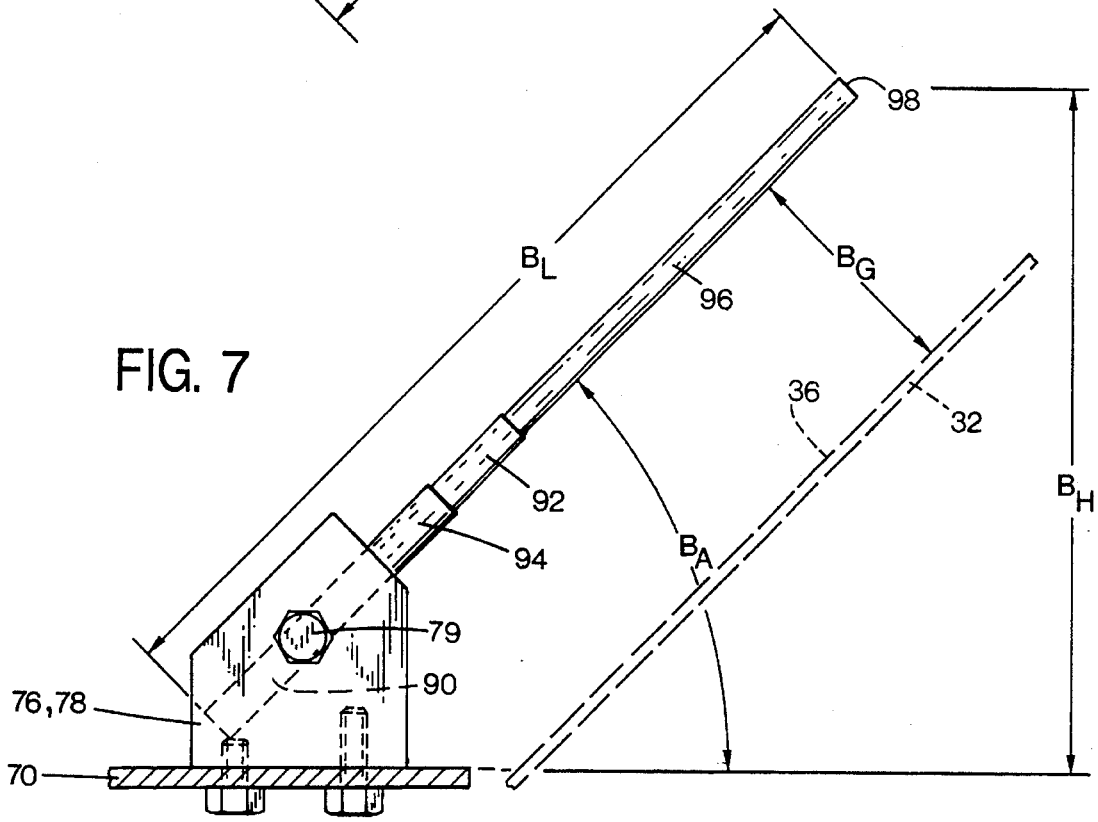
FIG. 7 is a side elevational view of one blade taken along line 7—7 of FIG. 6.

Referring now to FIGS. 5–7, one preferred form of a rotatable agitator assembly 50 has a rotatable disk-shaped base or blade support 70 which may be coupled to shaft 52 as shown in FIG. 1. The agitator assembly 50 has four radial blades comprising two pair of blades **72*a*, 72*b* and 74*a*, 74*b*, which are equally spaced at 90° quadrants around the periphery of the blade support 70 as shown in FIG. 6. Where features are common to each of the blades 72*a*, 72*b*, 74*a* and 74*b*, the blades will be referred to herein as "blades 72, 74." For example, each of the blades 72, 74 has a distal blade end or tip 75 projecting upwardly into the conical section 36**.

Referring to FIG. 7, the blade angle $B_A$ of each blade **72*a*, 72*b*, 74*a* and 74*b* is set at a fixed value with respect to the blade support 70 by blade mounting or retaining members or blocks 76*a*, 76*b*, 78*a* and 78*b*, respectively. Each of the blades are secured at a first or base end within their respective mounting blocks by a retaining device, such as bolt 79. The number of blades 72, 74** tested in the prototype units ranged between 3 and 6 blades, with a preferred range being 4–6 blades and the most preferred operating assembly having six mixing blades and two lifting blades.

In the illustrated embodiment, the first set of blades **72*a* and 72*b* has a blade angle $B_A$ of 40°, and the second set of blades 74*a* and 74*b* has a blade angle $B_A$ of 45°. In the prototype units, the blade angle $B_A$ range tested was 40°–90°, with a preferred range of 40°–60°, and the most preferred position being at 45° from horizontal. Thus, in the illustrated embodiment, the mixing blades are preferably oriented at an angle of 40° to 60° relative to a plane perpendicular to the axis of rotation of the mixing blades. In a preferred embodiment, it is desirable to position the blades 72, 74 at a blade angle $B_A$ which is close to being parallel with the walls of the conical section 34. Furthermore, a blade gap spacing $B_G$ of the blade tip 75 within a range of about two to about six inches from the wall is desirable to provide the desired flow pattern 60 of FIGS. 2–4**.

Also referring to Tables 1–4, the prototype blenders tested had a blade tip to tip diameter $B_{DIAM}$ (see FIG. 6) of 15 inches for the small blender, and 32.5 inches for the large blender. The blade length $B_L$ in the prototype small blender was 10 inches, while in the large blender the blade length was 16 inches (see FIG. 7). For scaling purposes, the blade length $B_L$ is preferably related to the cone height D of the conical section 34 of chamber 30 (see FIG. 1). The range of blade lengths tested was 50–90% of the cone height D, with a preferred range of 60–70%, and a most preferred operating blade length $B_L$ of 65% of the cone height D. For the speeds of motor 54 mentioned above, and the blade configurations described herein, the prototype units had a blade tip speed, that is the speed at which the distal end 75 traveled, ranged from 0 to 10,000 feet per minute. A preferred tip speed range is 4,700–9,000 feet per minute, with a most preferred range being 6,000–9,000 feet per minute.

The agitator assembly 50 may also include at least one pair of fiber lifting or lifter blades or lifters **80*a* and 80*b* tangently mounted to the blade support 70 by lifter blade retaining members or blocks 82*a* and 82*b*, respectively. By tangentially mounted, it is meant that the lifter blades are tangential to a right cylinder having its longitudinal axis coaxial with the axis of rotation of the blade support. A retaining device, such as a retaining bolt 83, may be used to secure the lifter blades 80*a* and 80*b* within their respective lifter retainer blocks 82***a* and 82*b*. Where features are common to each of the lifters 80*a* and 80*b*, the lifter will be referred to herein as "lifters blades or lifters 80." The optional lifters 80*a* and 80*b* (not shown for the agitator assembly 50' of FIG. 1) advantageously improve performance, especially when processing higher mass loadings, such as higher fiber loadings and SAP or superabsorbent particles.

For example, the lifters 80 project tangentially from the blade support 70, also at an angle $B_A$ as shown in FIG. 7. For the lifter blades 80, the angle $B_A$ may be fixed, or with the use of an adjustable lifter retaining block (not shown), may be varied to accommodate the varying types of fibers 25 and liquid coatings 24 being processed. For instance, a greater angle $B_A$ may be required for the lifter blades when higher mass loadings are used, as opposed to lower mass loadings.

The lifter blades 80*a* and 80*b* are shown in FIGS. 5 and 6 with an "aft swept" orientation. For instance, when the blade support 70 is rotated in the direction indicated by arrow R, a proximate base end 84 of the lifter adjacent the mounting block 82*b*, for example, leads a distal end or tip 86 of lifter blade 80*b*, or the tip 86 may be said to lag the base end 84.

Figure 8A:
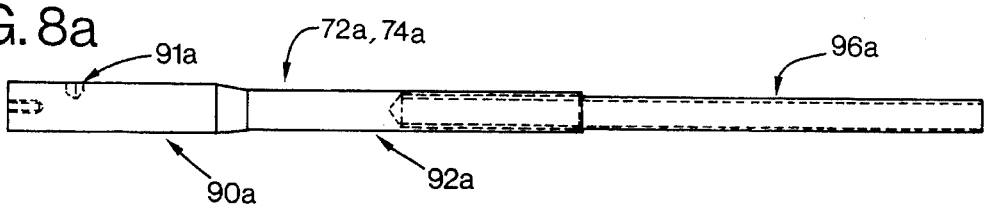
FIG. 8*a* is a longitudinal view of another form of a blade of the present invention.

Referring to FIGS. 8, 8*a*, and 9, typical configurations of blades 72, 74 are illustrated. The blades 72, 74 are preferably tubular, over at least a part of the blade length, and have a diameter which changes over the blade length. The conditions under which the blades 72, 74 operate requires blades of high strength, low mass and small sections to avoid blade failure and to minimize fiber buildup on blades. The illustrated blade embodiment addresses these requirements by providing a blade 72, 74 of high strength, high alloy aluminum, combined with specifically varying section moduli. The lifter blades 80 may also have the same construction as illustrated in FIGS. 8 and 9 or 10, which advantageously reduces stocks of replacement parts, as well as simplifying maintenance and replacement.

Figure 7A:
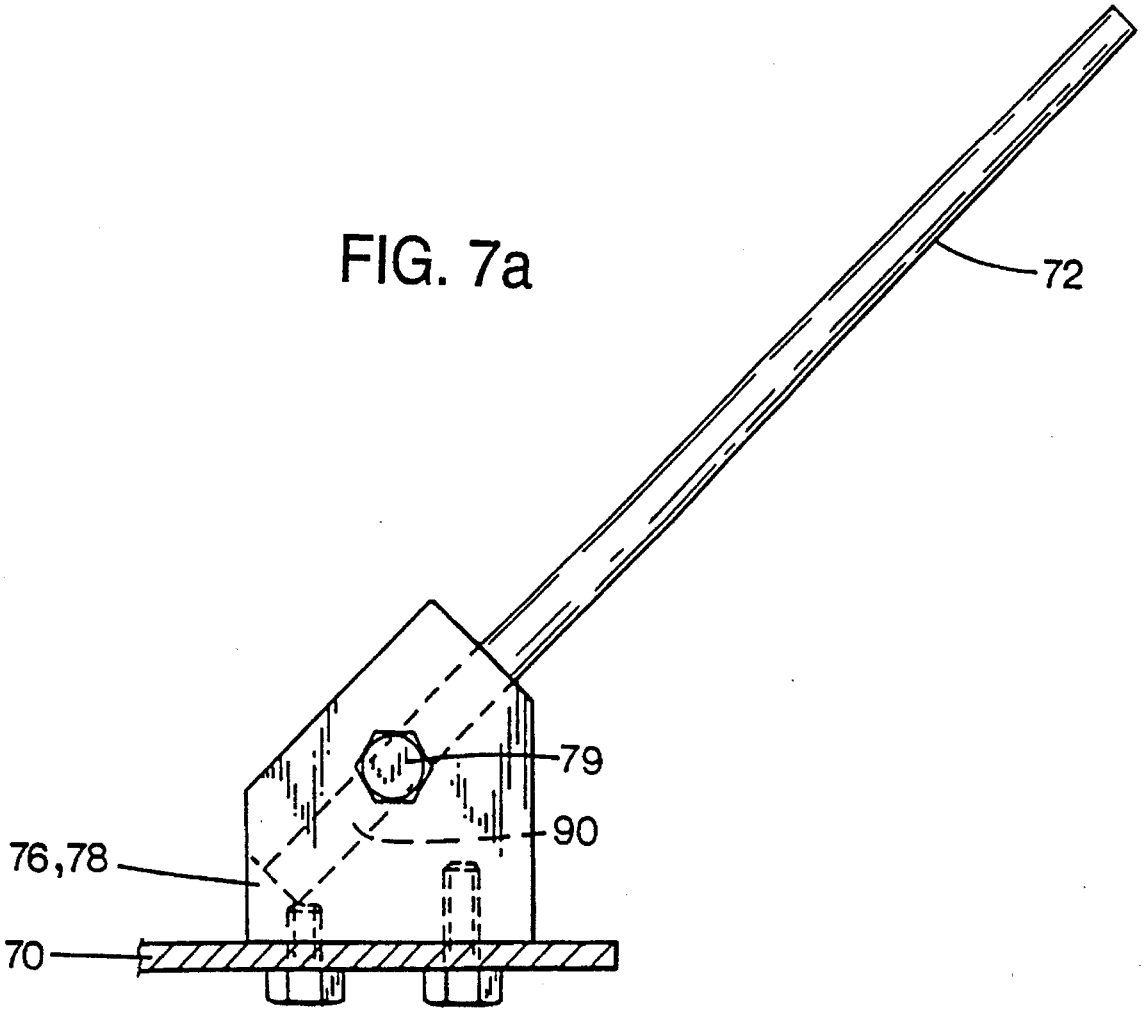
FIG. 7*a* is a side elevational view of one blade of a form which tapers towards its distal end.

The illustrated blades 72, 74 include a blade base 90 of 7014 aluminum alloy. The base 90 has a mounting hole 91 therethrough for receiving the retaining bolt 79. A tubular intermediate blade member 92 is mounted to base 90 at a shouldered recess 93 formed in the base 90. The intermediate blade member 92 may be of 2024 T3 aluminum alloy. An outer protective tubular sheathing member 94 extends over a portion of the base 90 and the intermediate blade member 92 to provide a more secure blade assembly and to prevent wear. The sheathing member 94 may be of a 6061 T6 machine grade aluminum alloy. A tubular blade tip member 96 is received within the intermediate blade member 92 and extends from the base member 90 to terminate in at the distal blade end 75. The blade tip member 96 may be of a 2024 T3 aluminum alloy. Alternatively, as shown in FIG. 7*a*, each of the blades 72 may taper toward its distal end.

With reference to FIG. 8*a*, which shows the presently preferred blade construction, the blades 72*a*, 74*a* (the subscript a being used to denote components of blades of this construction from corresponding components in FIG. 8) include a base (90*a*) of 4340 steel and a tip 96*a* of tubular graphite. The blade section 92*a* has a socket for receiving the end of tip 96*a*, which may be secured, as by adhesive, within the socket.

FIG. 10 illustrates an alternate embodiment of a blade 72, 74 or of a lifter 80 having a tip member 96' with an elliptical cross section, as opposed to the circular cross section of tip member 96 illustrated in FIGS. 8 and 9. In some applications, it may be particularly advantageous to strengthen and streamline the blades by providing the elliptical blade tip 96' oriented with the minor diameter radial to, and the major diameter of the ellipse tangent to, the rotation of blade support 70, as indicated by arrow R in FIG. 10. By orienting the minor diameter within about five degrees of radial, it is expected that some lift would be added to the fibers by the blades.

The elliptical shape of tip member 96' strengthens the blades 72, 74 in one direction, that is along the major axis of the ellipse relative to the minor axis which is perpendicular to the major axis. That is, the stiffness of the blade is increased per unit weight of the blade by changing the blade geometry without adding to the mass of blades 72, 74, or lifters 80.

Figure 11:
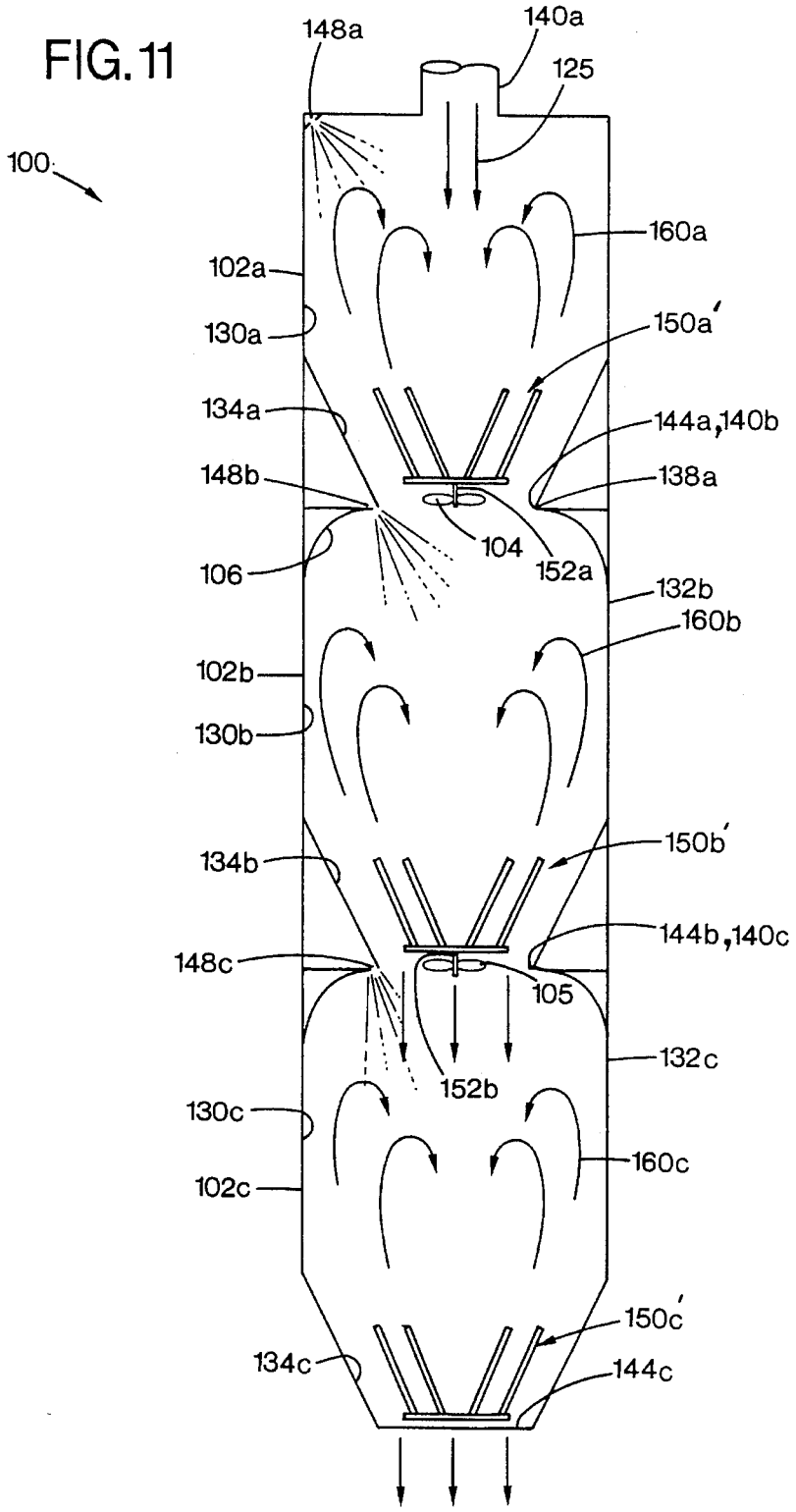
FIG. 11 is a schematic vertical sectional view of one form of a multi-stage hopper/blender of the present invention.
Figure 12:
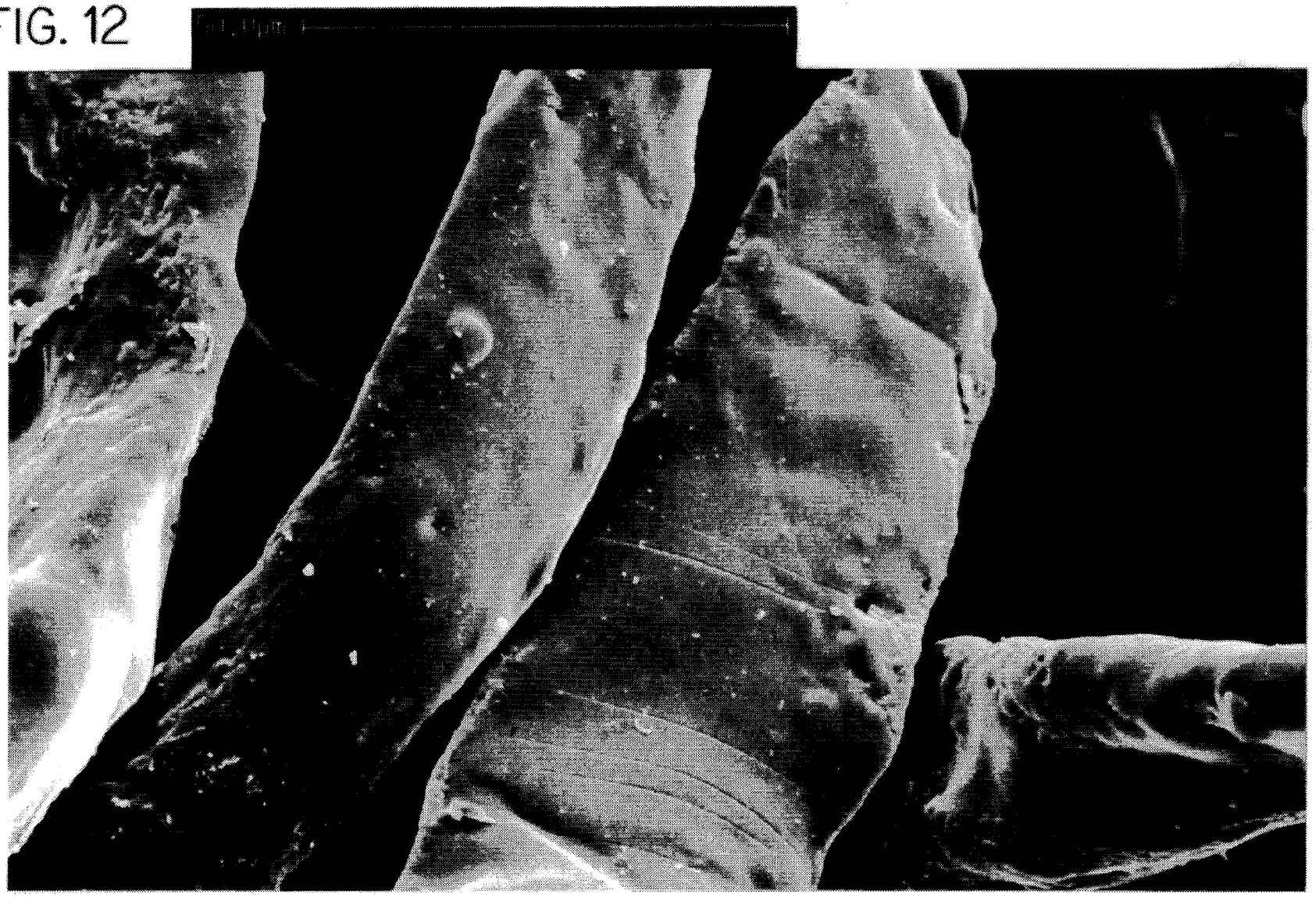
FIG. 12 is a spectrographic electron microscope photograph of fibers continuously coated in accordance with the present invention.

The apparatus of the present invention may be operated in batch or continuous modes. Also, plural mixing devices may be operated in parallel, in series, or in series/parallel configurations. As one specific example, and referring to FIG. 11, a continuous in-line hopper/blender 100 is shown having a plurality of hopper/blender sections 102*a*, 102*b* and 102*c* stacked upon one another for a continuous downwardly progression of entrained fibers 125 therethrough. Each of the sections 102*a*–102*c* may be substantially as described with respect to hopper/blender 20 of FIG. 1, with several modifications. Thus, components in FIG. 12 are labeled with item numbers increased by 100 over the item numbers of like components in FIG. 1, with the addition of the lower case letters "a, b or c" to distinguish the component as belonging to either section 102*a*, 102*b* or 102*c*, respectively.

The sections or stages 102*b* and 102*c* are considered to be "latter" stages with respect to the first stage 102*a*, and 102*c* is considered to be a latter stage with respect to the intermediate stage 102*b*. The outlet of an upper hopper/blender section is directly coupled with the inlet of a lower hopper/blender section. For example, the lower fiber delivery outlet 144*a* at the chamber base 138*a* of section 102*a* is directly coupled with the fiber inlet 140*b* of section 102*b*. Furthermore, in the continuous in-line blender 100, there is no particular need for an upper fiber delivery outlet, such as 42 of FIG. 1, unless for instance it would be desirable to extract test or sample fibers from the various sections during processing. The spray nozzle 148 in each section may be located adjacent the edge of fiber inlet 140.

Furthermore, it may be advantageous to promote fiber flow between the adjacent sections 102 by the addition of fan blades, such as 104 and 105 between the respective sections 102*a*, 102*b* and 102*b*, 102*c*. The fan blades 104 and 105 may be mounted upon the agitator assembly shafts 152*a* and 152*b*, respectively, of the respective agitator assemblies 150*a'* and 150*b'*. While each of the agitator assemblies 150*a'*, 150*b'* and 150*c'* may each be driven by separate motors (not shown), it may be also advantageous to link each of the agitator assemblies by a common shaft (not Shown).

The toroidal flow pattern in each section 102, such as pattern 160*b*, may be adjusted by adjusting the size of the fiber inlet 140, the amount of auxiliary air flow provided by an air supply (not shown, but similar to air supply 56 in FIG. 1). The configuration of the toroidal flow pattern 160 of the entrained fibers 125 may also be affected by the action of fan blades 104 and 105. It may be particularly advantageous to contour the tanks 132 to have a smooth inner surface for the upright chamber 130, for instance by providing a curved upper surface 106 to reduce undesirable eddies and backflows near the upper portion of chamber 130*b*.

Thus, the fibers 125 enter through fiber inlet 140*a* where they receive a liquid coating spray from nozzle 148*a* and are circulated through a toroidal pattern 160*a* by the agitator assembly 150*a'*. The fibers then exit chamber 130*a* through the fiber delivery outlet 140*a*, perhaps with the assistance of fan 104 if used. The fibers then proceed directly into the inlet 140*b* of section 102*b* where they receive a spray coating from nozzle 148*b* and are circulated through a toroidal pattern 160*b* by the agitator assembly 150*b'*. The coated fibers then exit chamber 130*b* via the fiber delivery outlet 144*b* and enter the fiber inlet 140*c* with the assistance of fan 105, if used. In section 102*c*, the fibers receive spray from nozzle 148*c* and are agitated into a toroidal pattern 160*c* by the agitator assembly 150*c'*. The fibers coated in section 102*c* may then exit through a lower fiber delivery outlet 144*c*, and enter a succeeding hopper/blender stage (not shown), or the fibers may proceed to the next manufacturing process or to storage (not shown).

Using the illustrated hopper/blender 20 as an example, a method of coating fibers 25 will be discussed. This method integrates three concerns: high mixing rate, fiber deagglomeration, and suitably atomized liquid coating application.

First, addressing the high mixing rate issue, the preferred hopper/blender 20 described herein is capable of providing complete mixing within five seconds. For applying a liquid coating material 22 of latex, the mixing provided by hopper/blender 20 must be sufficient to completely integrate the latex coating with the fibers 25. Also, due to the rapid mixing rate achievable in the hopper/blender of the present invention, the present invention is also useful in blending applications in which plural types of fiber are mixed or blended together.

Second, regarding the deagglomeration facet, typical transport mechanisms for pulp fiber cause agglomeration or flocculation of the fibers 25. Transporting fiber using these typical transport mechanisms usually results in softball-sized wads or clumps of fiber two to eight inches in diameter. This agglomeration phenomenon is disadvantageously accentuated when moisture or latex are present, which enhances the tendency of the fiber wads to remain agglomerated. Breaking apart the undesirable wads of fiber formed during a fiber mixing or transport stage (not shown) is important to adequately coat the fibers 25 inside the clumps or wads. Finer and/or faster deagglomeration of the clumps leads to more uniform coating of the fibers 25, and fewer undesirable pills, fiber bundles, or tightly twisted and adhered fibers, and other clumps. The result is individually coated unbonded fibers.

Third, application of suitable atomized liquid coating material 22, such as latex, greatly enhances the coating quality of the finished product. The atomization provided depends upon the nozzle 48, as well as the type of liquid coating material 22 and other factors known to those skilled in the art, such as temperature and humidity. An optimum size for the atomized liquid coating droplets or particles appears to be on the order of the size of the typical fiber diameter, such as 20 microns for many wood pulp fibers. Larger droplets in the liquid coating spray provided by nozzle 48 can lead to a blotchy coating on the fibers 25, and higher agglomeration (e.g. wads, nits and clumps). At the other end of the spectrum, very fine atomization often leads to an incomplete coating, possibly because the finer droplets dry too quickly before landing on the fibers to form a film or coat. Although bulk individual substantially continuously coated fibers and fibers with a substantial majority of their surface areas coated with a binder or other coating material offer many advantages, partially coated fibers also are useful for specific applications.

Thus, an apparatus and a method of applying a liquid coating material 22 to a mass of discontinuous fibers 25 is accomplished to at least partially coat the fibers with coating material 22. By mixing and confining the fibers 25 within the chamber 30, for instance by revolving the upper surface 64 lying within tilted plane P about the upright axis L as shown in FIGS. 2–4, the fibers entrained in the toroidal mass 60 may be substantially continuously coated. This method and apparatus is especially advantageous because of its space savings, energy savings and low maintenance characteristics. Furthermore, the simplified blade geometry of the blades 72, 74, as well as of the lifting blades 80, reduces the maintenance and cleaning requirements of the hopper/blender 20. Furthermore, the simplified blade geometry produces less damage to the fibers 25 and is safer for a maintenance crew to work around, since the blades have rounded contours, rather than the sharp edges of planar or paddle-type blades. Additionally, by replacing the retaining blocks 76, 78, the blade angle can easily be changed. Alternatively, different agitator assemblies 50 may be provided with blades 72, 74 and lifter blades 80 of different lengths, or having different blade angles $B_A$.

To further illustrate the invention, and not to be construed as a limitation, several specific examples will next be described.

EXAMPLE 1

A bleached Kraft Southern Pine cellulose fiber pulp sheet (NB-316 from Weyerhaeuser Company) was fiberized in a hammer mill. Two thousand grams of the fiberized fluff was then entrained in a hopper blender of FIG. 1 with the blade configuration of FIG. 5. The hopper blender utilized was the large blender described in Table I operated at 1200 rpm. The hopper cone angle was 40° from horizontal. In addition, the four mixing blades were oriented at an angle of 45° from horizontal and the two lifting blades were at an angle of 20° from horizontal. After less than five seconds of entrainment, 1937 grams of polyvinyl acetate terpolymer, 45 percent solids, was sprayed onto the entrained fiber over a period of two minutes and 49 seconds. A nozzle B25A from Spraying Systems Company utilizing 25 psi liquid pressure and 50 psi atomizing air pressure was used to apply the binder to the fibers. The polyvinyl acetate terpolymer is a thermoplastic binder material which is available from Reichold Chemical, Inc., of Dover, Del. The material was dried at a temperature of about 140° F. for three seconds in the dryer.

Even though wood fibers are of irregular cross-section and thus more difficult to coat than surfaces with a regular cross section or smooth surface, the resultant fibers had a uniform continuous coating of binder. FIG. 12 illustrates fibers produced in this manner and their substantially continuous coating. This figure is at a magnification of 800 times.

Testing of fibers produced in this manner has confirmed that bulk continuously coated unbonded fibers are readily produced. For example, it is not unusual to observe over eighty percent of a batch of treated fibers to have at least 90 percent of their surface area covered. In addition, very few fibers (e.g. 15 percent) have less than 60 percent of their surface area completely covered with binder. By increasing the amount of binder applied and extending the binder application time, the amount of surface area covered can be increased. Conversely, partially covered fibers can also be produced by applying less binder or by applying binder in relatively large or small drops. Also, in this example, approximately 95 percent of the fibers were unbonded to one another by the binder material. The dried fiber can easily be air laid and bonded by, for example, thermal bonding to form structures of high strength. These fibers may be densified and may also be molded as well. In addition, the fibers may be blended with other fibers and bonded, as by thermal or adhesive bonding, as desired.

A wide variety of other binders have also been tested. Cellulose wood pulp fibers having 5 percent, 7 percent, 10 percent, 20 percent, 30 percent and 50 percent by dry weight binder coating have been manufactured using the present method and apparatus. It is only at levels of about 7 percent that a substantially continuous coating of a substantial majority of the fibers is achieved. At 5 percent, the binder material is present as non-interconnected areas or blobs on the surface of the fibers.

EXAMPLE 2

A bleached Kraft Southern Pine cellulose fiber pulp sheet (NB-316 from Weyerhaeuser Company) was fiberized in a hammer mill. In addition, 4000 grams of the fiberized fluff was then entrained in a hopper blender of FIG. 1 operated as described in Example 1. After less than five seconds of entrainment, 2666 grams of polyvinyl acetate 3666H (from H. B. Fuller Co. of Minneapolis, Minn.) in a 47 percent solids dispersion was sprayed onto the entrained fiber over a period of two minutes and 14 seconds. The spraying nozzle and pressures were the same as described in Example 1.

To demonstrate the applicability of the apparatus to adhering particulate materials to fibers, superabsorbent particles were added to the entrained fibers (while damp with binder) utilizing a venturi-type feed nozzle with an 80 psi air infeed. Specifically, 5450 grams of superabsorbent particles (Sanwet 1M-1000, available from Celanese Corporation) were added in this manner over a three minute 31 second time period. The coated fiber was then discharged through a tube dryer as in Example 1. Adhesion was enhanced by drying the binder during passage of the fibers through the dryer as the fibers were discharged. A wide range of binder and particulate concentrations (percentage by weight binder to binder plus fiber plus particulate; percentage by weight particulate to binder plus fiber plus particulate) can be produced using this approach. For example, fibers with adhered superabsorbent particles up to about sixty percent by weight to the weight of the binder, fiber and particles can be produced.

Again with at least about 7 percent binder concentration, a substantially continuous binder coating of the fibers can be produced. More specifically, it has been found that a binder concentration of 7 percent will adhere some particulate material to the fibers, but at binder concentrations of 20 percent and higher of the total dry weight of the binder, fiber and additives, and higher, much better adhesion occurs. Also, a very uniform distribution of superabsorbent particles would be present in webs produced from fiber with adhered superabsorbent particles with or without other fibers blended therein. In the same manner plural binders and/or plural particulates may be adhered to fibers utilizing the hopper blender of the present invention.

Having illustrated and described the principles of our invention with respect to a preferred embodiment, it should be apparent to those skilled in the art that our invention may be modified in arrangement and detail without departing from such principles. For example, other locations of fiber entry and discharge, auxiliary air entry, and nozzles may be employed, as well as suitable material substitutions and dimensional variations for the components of the hopper/blender system. We claim all such modifications falling within the scope and spirit of the following claims.

We claim:

1. A fiber coating apparatus for applying a liquid coating material to discontinuous fibers comprising:

an upright chamber having an upper chamber wall and a fiber receiving inlet through which fibers to be treated are delivered to the chamber and a fiber delivery outlet from which fibers with applied liquid coating material are removed from the chamber, the chamber having an inverted conical section which has a base and an upper end, the inverted conical section having an annular wall extending between the base and the upper end;

a rotatable blade support positioned within the chamber at the base for rotation about an upright axis;

a motor coupled to the blade support for rotating the blade support;

plural elongated mixing blades each having a blade body with one end mounted to the blade support and a distal end projecting outwardly from the blade support toward the upper chamber wall and into the inverted conical section of the chamber, the blade body extending from said one end above and being spaced from the blade support;

at least two fiber lifting blades each having first and second ends, the first end being coupled to the blade support and the second end comprising a distal end projecting upwardly from the blade support, the fiber lifting blades projecting in a direction relative to the direction of rotation of the blade support such that the second end of each fiber lifting blade lags the first end of each such fiber lifting blade in the direction of rotation of the blade support;

a coating material applier positioned to direct droplets of the liquid coating material onto fibers in the chamber; and the motor rotating the blade support to rotate the mixing and fiber lifting blades to entrain fibers in air within the chamber with the droplets of coating material applied to the air entrained fibers providing at least a partial coating by the coating material applier of the coating material on the air entrained fibers.

2. An apparatus according to claim 1 in which the chamber has an upright longitudinal axis, the blade support being positioned for rotation about the longitudinal axis of the chamber.

3. An apparatus according to claim 1 in which the inverted conical section has walls which angle upwardly relative to horizontal at an angle of from about forty-five degrees to about sixty degrees.

4. An apparatus according to claim 1 in which the height of the inverted conical section is from about forty percent to about sixty percent of the maximum diameter of the inverted conical section.

5. An apparatus according to claim 1 in which the chamber has an upper cylindrical section positioned above the inverted conical section.

6. An apparatus according to claim 1 in which the chamber has an upper cylindrical section positioned above the inverted conical section, the height of the inverted conical section being from about forty percent to about sixty percent of the diameter of the upper cylindrical section.

7. An apparatus according to claim 1 wherein the distal ends of the mixing and fiber lifting blades are rotated at from about forty-seven hundred to about nine thousand feet per minute.

8. An apparatus according to claim 1 wherein the blade support is rotated at from about twelve hundred to about eighteen hundred revolutions per minute.

9. An apparatus according to claim 1 wherein there are at least four mixing blades, the distal ends of said four mixing blades being positioned no closer than from about two inches to about six inches from the annular wall of the inverted conical section.

10. An apparatus according to claim 1 wherein there are at least four mixing blades, the blades projecting upwardly from the blade support and outwardly relative to the upright axis, the mixing blades being oriented at a blade angle of from about forty degrees to about sixty degrees relative to horizontal.

11. An apparatus according to claim 10 wherein the mixing blade angle is about forty-five degrees.

12. An apparatus according to claim 11 wherein the mixing blades are disposed at equal distances about the periphery of the blade support.

13. An apparatus according to claim 1 wherein each of the mixing and lifting blades comprises a tubular member.

14. An apparatus according to claim 1 wherein each of the mixing and lifting blades is of circular cross-section.

15. A fiber coating apparatus according to claim 1 wherein each of the mixing blades tapers toward its distal end.

16. An apparatus according to claim 1 including an air supply for introducing pressurized air into the chamber at a location above the blade support.

17. An apparatus according to claim 1 wherein the coating material applier is configured to direct droplets of a liquid binder coating material into the chamber to at least partially coat the entrained fibers with the binder.

18. A fiber coating apparatus for applying a liquid coating material to discontinuous fibers comprising:

an upright chamber having a fiber receiving inlet through which fibers to be treated are delivered to the chamber and a fiber delivery outlet from which fibers with applied liquid coating material are removed from the chamber, the chamber having an inverted conical section with a base;

a rotatable blade support positioned within the chamber at the base for rotation about an upright axis;

a motor coupled to the blade support for rotating the blade support;

plural elongated blades each having one end mounted to the blade support and a distal end projecting outwardly from the blade support and into the conical section of the chamber;

a coating material applier positioned to direct droplets of the liquid coating material into the chamber;

the motor rotating the blade support to rotate the blades to entrain fibers within the chamber with the droplets of coating material applied to the entrained fibers providing at least a partial coating of the coating material on the entrained fibers; and wherein the chamber has plural inverted conical sections, each with a respective base, the conical sections being coupled together such that fiber passes through the chamber to successive conical sections, a rotatable blade support being provided at the base of each conical section, a motor for rotating each blade support, a plurality of the blades being mounted to each blade support, the blades projecting upwardly into the conical sections, a coating material applier positioned to direct droplets of coating material into each conical section, whereby rotation of each blade supports rotates the blades to thereby entrain the fibers within the conical sections as the fibers pass from conical section to conical section with the droplets of coating material applied to the entrained fibers in each conical section providing at least a partial coating of the coating material on the entrained fibers.

19. An apparatus according to claim 18 in which the chamber comprises plural chamber sections each interconnected by a conduit and each chamber section including at least one of the aforesaid conical sections.

20. An apparatus according to claim 19 including a fan between each channel section.

21. An apparatus according to claim 20 in which each fan comprises a rotary fan coupled to a respective one of the blade supports.

22. A fiber coating apparatus for applying a liquid coating material to discontinuous fibers comprising:

an upright chamber having a fiber receiving inlet through which fibers to be treated are delivered to the chamber and a fiber delivery outlet from which fibers with applied liquid coating material are removed from the chamber, the chamber having an inverted conical section with a base;

a rotatable blade support positioned within the chamber at the base for rotation about an upright axis;

a motor coupled to the blade support for rotating the blade support;

plural elongated blades each having one end mounted to the blade support and a distal end projecting outwardly from the blade support and into the conical section of the chamber;

a coating material applier positioned to direct droplets of the liquid coating material into the chamber;

the motor rotating the blade support to rotate the blades to entrain fibers within the chamber with the droplets of coating material applied to the entrained fibers providing at least a partial coating of the coating material on the entrained fibers; and the apparatus including at least four of the blades, the blades projecting upwardly from the blade support and outwardly relative to the upright axis, the blades being oriented at a blade angle of from about forty degrees to about sixty degrees relative to horizontal, and the apparatus further including at least two additional mixing blades, the mixing blades being disposed 180 degrees apart about the periphery of the blade support and midway between a respective pair of the blades, the mixing blades projecting upwardly from the blade support and outwardly relative to the upright axis.

23. An apparatus according to claim 22 wherein the additional mixing blades are oriented at a blade angle of 40 degrees relative to horizontal.

24. A fiber coating apparatus for applying a liquid coating material to discontinuous fibers comprising:

an upright chamber having a fiber receiving inlet through which fibers to be treated are delivered to the chamber and a fiber delivery outlet from which fibers with applied liquid coating material are removed from the chamber, the chamber having an inverted conical section with a base;

a rotatable blade support positioned within the chamber at the base for rotation about an upright axis;

a motor coupled to the blade support for rotating the blade support;

plural elongated blades each having one end mounted to the blade support and a distal end projecting outwardly from the blade support and into the conical section of the chamber;

a coating material applier positioned to direct droplets of the liquid coating material into the chamber;

the motor rotating the blade support to rotate the blades to thereby entrain fibers within the chamber with the droplets of coating material applied to the entrained fibers providing at least a partial coating of the coating material on the entrained fibers; and the apparatus including at least four of the blades, the blades protecting upwardly from the blade support and outwardly relative to the upright axis, the blades being oriented at a blade angle of from about forty degrees to about sixty degrees relative to horizontal and the apparatus also further including a pair of fiber lifting blades each having first and second ends, the first end being mounted to the blade support and the second end comprising a distal end projecting upwardly from the blade support, the fiber lifting blades projecting in a direction relative to the direction of rotation of the blade support such that the second end of each such lifting blade lags the first end of each such lifting blade in the direction of rotation of the blade support.

25. An apparatus according to claim 24 in which the lifting blades are spaced apart one hundred and eighty degrees about the periphery of the blade support.

26. An apparatus according to claim 25 in which the lifting blades are oriented at an angle of about forty-five degrees from horizontal.

27. An apparatus according to claim 24 wherein the second end of each such mixing blade is tangent to a right cylinder projecting upwardly from the blade support, the right cylinder having its longitudinal axis coaxial with the axis of rotation of the blade support.

28. A fiber coating apparatus for applying a liquid coating material to discontinuous fibers comprising:

an upright chamber having a fiber receiving inlet through which fibers to be treated are delivered to the chamber and a fiber delivery outlet from which fibers with applied liquid coating material are removed from the chamber, the chamber having an inverted conical section with a base;

a rotatable blade support positioned within the chamber at the base for rotation about an upright axis;

a motor coupled to the blade support for rotating the blade support;

plural elongated blades each having one end mounted to the blade support and a distal end projecting outwardly from the blade support and into the conical section of the chamber;

a coating material applier positioned to direct droplets of the liquid coating material into the chamber;

the motor rotating the blade support to rotate the blades to entrain fibers within the chamber with the droplets of coating material applied to the entrained fibers providing at least a partial coating of the coating material on the entrained fibers; and wherein each of the blades has a tip with an elliptical cross-section.

29. An apparatus according to claim 28 wherein the elliptical cross-section of each of the blades has a major and a minor diameter, with the blade oriented so as to align the minor diameter within about five degrees of radial with respect to the blade support rotation.

30. An apparatus comprising:

an upright chamber having a fiber receiving inlet through which fibers are delivered to the chamber and a fiber delivery outlet from which fibers are removed from the chamber, the chamber having an inverted conical section with a base;

a rotatable blade support positioned within the chamber at the base for rotation about an upright axis;

a motor coupled to the blade support for rotating the blade support about an axis of rotation;

at least four elongated mixing blades each having one end mounted to the blade support and a distal end projecting upwardly from the blade support and outwardly relative to the axis of rotation and into the inverted conical section of the chamber, the mixing blades being oriented at a blade angle of from about forty degrees to about sixty degrees relative to a plane perpendicular to the axis of rotation;

the motor rotating the blade support to rotate the mixing blades to entrain and mix fibers within the chamber; and the chamber having plural inverted conical sections, each with a respective base, the inverted conical sections being coupled together such that fiber passes through the chamber to successive inverted conical sections, a rotatable blade support being provided at the base of each inverted conical section, a motor for rotating each blade support, plural elongated blades mounted to each blade support, the blades projecting upwardly into the inverted conical sections, whereby rotation of each blade supports rotates the blades to thereby entrain and mix the fibers within the inverted conical sections as the fibers pass from inverted conical section to inverted conical section; and a coating material applier positioned to direct droplets of the liquid coating material onto fibers in the chamber.

31. An apparatus according to claim 30 in which the chamber comprises plural chamber sections each interconnected by a conduit and each chamber section including at least one of the aforesaid inverted conical sections, and the apparatus including a fan between each chamber section.

32. A fiber coating apparatus comprising:

an upright chamber having a fiber receiving inlet through which fibers are delivered to the chamber and a fiber delivery outlet from which fibers are removed from the chamber, the chamber having an inverted conical section with a base;

a rotatable blade support positioned within the chamber at the base for rotation about an upright axis;

a motor coupled to the blade support for rotating the blade support about an axis of rotation;

at least four elongated mixing blades each having one end mounted to the blade support and a distal end projecting upwardly from the blade support and outwardly relative to the axis of rotation and into the inverted conical section of the chamber, the mixing blades being oriented at a blade angle of from about forty degrees to about sixty degrees relative to a plane perpendicular to the axis of rotation;

a coating material applier positioned to direct droplets of the liquid coating material onto fibers in the chamber;

the motor rotating the blade support to rotate the mixing blades to entrain and mix fibers within the chamber; and the apparatus including at least two additional mixing blades, the additional mixing blades being disposed 180 degrees apart about the periphery of the blade support and midway between a respective pair of the mixing blades, such additional mixing blades projecting upwardly from the blade support and outwardly relative to the axis of rotation.

33. A fiber coating apparatus comprising:

an upright chamber having a fiber receiving inlet through which fibers are delivered to the chamber and a fiber delivery outlet from which fibers are removed from the chamber, the chamber having an inverted conical section with a base;

a rotatable blade support positioned within the chamber at the base for rotation about an upright axis;

a motor coupled to the blade support for rotating the blade support about an axis of rotation;

at least four elongated mixing blades each having one end mounted to the blade support and a distal end projecting upwardly from the blade support and outwardly relative to the axis of rotation and into the inverted conical section of the chamber, the mixing blades being oriented at a blade angle of from about forty degrees to about sixty degrees relative to a plane perpendicular to the axis of rotation;

a coating material applier positioned to direct droplets of the liquid coating material onto fibers in the chamber;

the motor rotating the blade support to rotate the mixing blades to thereby entrain and mix fibers within the chamber; and the apparatus including at least two fiber lifting blades each having first and second ends, the first end being mounted to the blade support and the second end comprising a distal end projecting upwardly from the blade support, the fiber lifting blades projecting in a direction relative to the direction of rotation of the blade support such that the second end of each such lifting blade lags the first end of each such lifting blade in the direction of rotation of the blade support.

* * * * *